US008228285B2

(12) United States Patent
Inada et al.

(10) Patent No.: US 8,228,285 B2
(45) Date of Patent: Jul. 24, 2012

(54) DISPLAY CONTROL APPARATUS AND METHOD, AND PROGRAM

(75) Inventors: Tetsuji Inada, Kanagawa (JP); Mitsuyasu Asano, Tokyo (JP); Koji Nishida, Tokyo (JP); Takeshi Hiramatsu, Tokyo (JP)

(73) Assignee: Sony Corporation (JP)

( * ) Notice: Subject to any disclaimer, the term of this patent is extended or adjusted under 35 U.S.C. 154(b) by 287 days.

(21) Appl. No.: 12/452,087

(22) PCT Filed: Apr. 16, 2009

(86) PCT No.: PCT/JP2009/057683

§ 371 (c)(1),
(2), (4) Date: Dec. 14, 2009

(87) PCT Pub. No.: WO2009/131058

PCT Pub. Date: Oct. 29, 2009

(65) Prior Publication Data

US 2010/0127964 A1 May 27, 2010

(30) Foreign Application Priority Data

Apr. 22, 2008 (JP) ..... P2008-111116

(51) Int. Cl.
*G09G 3/36* (2006.01)

(52) U.S. Cl. ..... 345/102; 345/690

(58) Field of Classification Search ..... 345/102, 345/87, 89, 204, 690; 349/61–71
See application file for complete search history.

(56) References Cited

U.S. PATENT DOCUMENTS

| | | | | |
|---|---|---|---|---|
| 7,027,016 | B2 | 4/2006 | Sakashita | |
| 7,474,289 | B2 | 1/2009 | Sakashita | |
| 7,796,114 | B2 * | 9/2010 | Shin et al. | 345/102 |
| 7,944,431 | B2 * | 5/2011 | Tanaka et al. | 345/102 |
| 2007/0285379 | A1 | 12/2007 | Jung et al. | |
| 2008/0068328 | A1 | 3/2008 | Jou et al. | |

FOREIGN PATENT DOCUMENTS

EP 1788550 A1 5/2007

(Continued)

OTHER PUBLICATIONS

Supplementary European Search Report EP 09734974, dated Sep. 28, 2011.

"Locally pixel-compensated backlight dimming on LED backlight LCD TV", SID_Journals, 1475 S. Bascom Ave., Ste. 114, Campbell, CA 95008-4006 USA, Dec. 15, 2007 XP 040426644.

*Primary Examiner* — Stephen Sherman
(74) *Attorney, Agent, or Firm* — Lerner, David, Littenberg, Krumholz & Mentlik, LLP

(57) ABSTRACT

The present invention relates to a display control apparatus and method, and a program which make it possible to suppress deterioration in the image quality of an image.

A backlight luminance calculating section (121) finds the backlight luminance of light to be radiated by a backlight, on the basis of the image signal of an image. A subtraction section (142) finds the difference between the backlight luminance from the backlight luminance calculating section (121), and a backlight luminance from an addition section (141). A multiplication section (143) multiplies the found difference by a cyclic coefficient indicating the degree of contribution of the difference to correction of the backlight luminance, obtaining a correction value. The addition section (141) adds the correction value to the backlight luminance to correct the backlight luminance. Also, from the image signal and the backlight luminance, a division section (124) calculates the transmittance of light in a liquid crystal panel that displays an image by transmitting light from the backlight. The present invention can be applied to a liquid crystal display apparatus.

7 Claims, 15 Drawing Sheets

FOREIGN PATENT DOCUMENTS

| | | | |
|---|---|---|---|
| JP | 2002-031846 | A | 1/2002 |
| JP | 2004-163518 | A | 6/2004 |
| JP | 2007-322901 | A | 12/2007 |
| JP | 2007-322945 | A | 12/2007 |

* cited by examiner

DISPLAY CONTROL APPARATUS AND METHOD, AND PROGRAM

CROSS-REFERENCES TO RELATED APPLICATIONS

The present application is a national phase entry under 35 U.S.C. §371 of International Application No. PCT/JP2009/057683 filed Apr. 16, 2009, published on Oct. 29, 2009 as WO 2009/131058 A1, which claims priority from Japanese Patent Application No. JP 2008-111116 filed in the Japanese Patent Office on Apr. 22, 2008.

TECHNICAL FIELD

The present invention relates to a display control apparatus and method, and a program, in particular, a display control apparatus and method, and a program which are suitable for use in cases where an image is displayed on a liquid crystal panel by using a plurality of backlights.

BACKGROUND ART

In the related art, as a liquid crystal display apparatus using a transmission type liquid crystal panel, there has been proposed one which uses a plurality of backlights to vary the quantity of incident light for each display region on the liquid crystal panel, thereby achieving an increase in the dynamic range of the brightness of a displayed image (see, for example, Patent Document 1).

In the case where each of a plurality of backlights makes light incident on each corresponding display region on the liquid crystal panel in this way, as shown in FIG. 1, the light quantity to be emitted by each backlight can be found from the image signal of an image to be displayed.

That is, in FIG. 1, an image signal having the stepped waveform indicated by arrow A11 is inputted to a light emission quantity calculating section 11 and a division section 12. In the light emission quantity calculating section 11, the light quantity to be emitted by each single backlight 13 is calculated on the basis of the image signal. Also, in the division section 12, the supplied image signal is divided by the light quantity from the light emission quantity calculating section 11, thereby computing the transmittance of light in a display region of a liquid crystal panel 14 corresponding to the backlight 13.

Here, since the size of each single backlight 13 is larger than the size of pixels in the display region of the liquid crystal panel 14, the light quantity from the backlight 13 is calculated from the pixel value of each pixel of an image displayed in the display region of the liquid crystal panel 14 corresponding to the backlight 13.

Then, once the light quantity is calculated, the backlight 13 emits light on the basis of the light quantity calculated by the light emission quantity calculating section 11, and makes the light incident on the liquid crystal panel 14. Thus, light having the waveform indicated by arrow A12 is radiated from the backlight 13. That is, since light from the backlight 13 is diffused, the light quantity is largest at the center of the light, and the light quantity decreases with increasing distance from the center.

Also, the liquid crystal panel 14 transmits light from the backlight 13 in accordance with the waveform indicated by arrow A13, that is, at a transmittance calculated by the division section 12. Thus, as indicated by arrow A14, substantially the same image as the image of an inputted image signal is displayed in the display region of the liquid crystal panel 14.

PRIOR ART DOCUMENTS

Patent Documents

Patent Document 1: Japanese Unexamined Patent Application Publication No. 2007-322901

DISCLOSURE OF INVENTION

Technical Problem

However, with the above-described technique, there are cases when the image quality of a displayed image deteriorates depending on the inputted image signal.

For example, since the response speed of a backlight and the response speed of a liquid crystal panel differ in a liquid crystal display apparatus, in the case of displaying such an image that a white dot moves on a black background, the image quality in the portion of the image around the white dot deteriorates. It should be noted that FIG. 2 shows the pixel value of each pixel of an image signal at each time, the light emission quantity at each position of the backlight, the waveform of light from the backlight, and the transmittance at each position of the liquid crystal panel. Also, in FIG. 2, the vertical direction shows the level (pixel value) of an image signal, light emission quantity, light quantity, or transmittance, and the horizontal direction shows position.

In FIG. 2, an image signal indicated by arrow A31 is inputted at time t1. Thereafter, an image signal indicated by arrow A32 is inputted at time t2.

In the image of the image signal indicated by arrow A31, the pixel values of pixels in a predetermined region are large, and the pixel values of pixels in the other regions are substantially zero. Also, the image of the image signal indicated by arrow A32 is obtained by moving the image indicated by arrow A31 to the right in the drawing. That is, the moving image displayed by the inputted image signals is an image in which a white dot moves from left to right on a black background, from a position indicated by arrow P11 (hereinafter, referred to as position P11) to a position indicated by arrow P12 (hereinafter, referred to as position P12).

When an image signal is inputted at time t1, the backlight radiates light having the waveform indicated by arrow A33. That is, the backlight radiates light in such a way that the brightness of a predetermined region centered about position P11 becomes uniform. Then, since the light radiated from the backlight is diffused, directly below the liquid crystal panel, as indicated by arrow A34, the light quantity of the light gently decreases with increasing distance from position P11, with position P11 as the center.

Also, when an image signal is inputted at time t1, the liquid crystal panel displays an image by transmitting light from the backlight, with the transmittance of each pixel set as the transmittance indicated by arrow A35. That is, in the liquid crystal panel, the transmittance of each pixel is varied so that the transmittance of pixels in a predetermined region centered about position P11 becomes high, and the transmittance of pixels outside the predetermined region becomes smaller than the transmittance of the pixels in the predetermined region. Also, outside the predetermined region, the transmittance of pixels near the boundary with the predetermined region is the lowest, and the transmittance of pixels becomes gradually higher as the distance from the boundary becomes farther.

Further, when the image signal indicated by arrow A32 is inputted at time t2, the backlight radiates light having the waveform indicated by arrow A36, and the light has the waveform indicated by arrow A37 when directly below the liquid crystal panel. Then, the liquid crystal panel displays an image by transmitting light from the backlight at the transmittance indicated by arrow A38. Here, the shape (waveform) represented by the light quantity or transmittance indicated by arrow A36 to arrow A38, and the shape (waveform) represented by the light quantity or transmittance indicated by arrow A33 to arrow A35 represent waveforms of the same shape, the only difference being the position of the center of the waveform.

In the case of displaying an image in which a white dot moves on a black background in this way, if the response speed of the backlight is faster than the response speed of the liquid crystal panel, between before and after the movement of the white dot, the brightness of a displayed image becomes different from the brightness at which the image is intended to be displayed.

That is, at the position indicated by arrow P13 (hereinafter, referred to as position P13), when time shifts from time t1 to time t2, a control is effected such that the light quantity of light radiated from the backlight increases, and the transmittance of pixels in the liquid crystal panel becomes lower. However, at position P13, although the light quantity of light incident on the liquid crystal panel increases immediately, since the response speed of the liquid crystal panel is slower than the response speed of the backlight, narrowing of the pixel aperture becomes insufficient, and the image at position P13 in the display region becomes brighter than the image intended to be displayed.

On the other hand, at the position indicated by arrow P14 (hereinafter, referred to as position P14), when time shifts from time t1 to time t2, a control is effected such that the light quantity of light radiated from the backlight decreases, and the transmittance of pixels in the liquid crystal panel becomes higher. However, at position P14, although the light quantity of light incident on the liquid crystal panel immediately decreases, since the response speed of the liquid crystal panel is slower than the response speed of the backlight, widening of the pixel aperture becomes slow, and the image at position P14 in the display region becomes darker than the image intended to be displayed.

Also, changing of the transmittance of the liquid crystal panel is performed line sequentially, that is, in turn for each line of continuously arranged pixels. For that reason, changing of the transmittance and changing of the light emission quantity of the backlight are not synchronized, and an image different from the intended image to be displayed is displayed in the display region of the liquid crystal panel at the time of switching screens.

For example, if, as shown in FIG. 3, three backlights, backlight 31-1 to backlight 31-3 emit light at the light emission quantity for displaying image A, and the liquid crystal panel 32 transmits light from the backlight 31-1 to the backlight 31-3 at the transmittance for displaying image A, image A is displayed in the display region of the liquid crystal panel 32.

It should be noted that the three curves on the right side of the backlight 31-1 to the backlight 31-3 in the drawing each indicate the waveform of light from each of the backlight 31-1 to the backlight 31-3. That is, of those curves in the drawing, the horizontal direction indicates light quantity (brightness), and the vertical direction indicates position. Also, each single rectangle in the backlight 32 represents a single pixel. Further, in the following, the backlight 31-1 to the backlight 31-3 will be simply referred to as backlight 31 in cases where there is no need to individually differentiate between them.

When, in a state in which image A is displayed on the liquid display panel 32, an image signal of image B is inputted, and the display is switched over from image A to image B, as shown in FIG. 4, the light quantity and transmittance of light are switched over in turn from the backlight 31 and the pixel on the upper side toward the lower side in the drawing.

In FIG. 4, the backlight 31-1 and the backlight 31-2 are emitting light at the light quantity for displaying image B, whereas the backlight 31-1 is still emitting light at the light quantity for displaying image A. Likewise, in the liquid crystal panel 32, the diagonally shaded pixels in the upper half are transmitting light at the transmittance for displaying image B, whereas the pixels in the lower half are still transmitting light at the transmittance for displaying image A.

Therefore, image B is displayed in the upper side of the liquid crystal panel 32, and image A is still displayed in the lower side. Also, at the central portion of the liquid crystal panel 32 in the drawing, pixels in the liquid crystal panel 32 transmit light of the light quantity for displaying image B, at the transmittance for displaying image A. Moreover, not only light from the backlight 31-2 but also light from each of the backlight 31-1 and the backlight 31-3 is incident on the pixels at the central portion of the liquid crystal panel 32 in the drawing. Thus, the displayed image is also affected by the light from those. As a result, an image that differs from both image A and image B is displayed at the central position of the liquid crystal panel 32.

In this way, since the timing at which the light quantity from the backlight 31 and the transmittance of pixels in the liquid crystal panel 32 are changed differs depending on the position, during switching of displays, an image different from the intended image to be displayed is displayed, causing deterioration in the image quality of the image. The deterioration of the image quality becomes particularly pronounced when the light quantity of light from the backlight 31 changes abruptly.

As described above, in the case of displaying an image on a liquid crystal panel by using a backlight, depending on the inputted image signal, there are cases where the image quality of a display image deteriorates.

The present invention has been made in view of the above-mentioned circumstances, and makes it possible to suppress deterioration in the image quality of a displayed image.

Technical Solution

A display control apparatus according to an aspect of the present invention includes luminance calculating means for calculating a backlight luminance on the basis of an image signal of a display image, the backlight luminance indicating a luminance of light which is made incident on a display panel that displays the display image by transmitting light, and which is radiated by a backlight, difference calculating means for calculating a difference between the backlight luminance of the display image of a predetermined frame to be displayed from now on, and the backlight luminance of the display image of a preceding frame temporally preceding the predetermined frame, correcting means for correcting the backlight luminance of the predetermined frame by using a correction value, which is determined by a coefficient indicating a degree of contribution of the difference to correction of the backlight luminance and by the difference, and transmittance calculating means for calculating a transmittance of light from the backlight in the display panel, on the basis of the corrected backlight luminance and the image signal.

The display control apparatus can be further provided with coefficient changing means for changing the coefficient on the basis of brightness of the display image.

The display control apparatus can be further provided with mean luminance calculating means for calculating a mean luminance of the display image on the basis of the image signal, and coefficient changing means for changing the coefficient on the basis of a difference between the mean luminance of the display image of the predetermined frame, and the mean luminance of the display image of the preceding frame.

The display control apparatus can be further provided with filtering means for applying filtering using a low-pass filter to the display image, and coefficient changing means for changing the coefficient, on the basis of the number of pixels with pixel values equal to or above a predetermined value in the display image of the predetermined frame to which the filtering has been applied.

The display control apparatus can be further provided with coefficient changing means for changing the coefficient on the basis of a difference between the backlight luminance of the predetermined frame, and the backlight luminance of the preceding frame.

Each of a plurality of the luminance calculating means can be configured to calculate the backlight luminance for each of a plurality of the backlights, and each of a plurality of the transmittance calculating means can be configured to calculate the transmittance with respect to each of regions of the display panel corresponding to the plurality of the backlights.

A display control method or a program according to an aspect of the present invention includes the steps of calculating a backlight luminance on the basis of an image signal of a display image, the backlight luminance indicating a luminance of light which is made incident on a display panel that displays the display image by transmitting light, and which is radiated by a backlight, calculating a difference between the backlight luminance of the display image of a predetermined frame to be displayed from now on, and the backlight luminance of the display image of a preceding frame temporally preceding the predetermined frame, correcting the backlight luminance of the predetermined frame by using a correction value, which is determined by a coefficient indicating a degree of contribution of the difference to correction of the backlight luminance and by the difference, and calculating a transmittance of light from the backlight in the display panel, on the basis of the corrected backlight luminance and the image signal.

According to an aspect of the present invention, a backlight luminance is calculated on the basis of an image signal of a display image, the backlight luminance indicating a luminance of light which is made incident on a display panel that displays the display image by transmitting light, and which is radiated by a backlight. A difference between the backlight luminance of the display image of a predetermined frame to be displayed from now on, and the backlight luminance of the display image of a preceding frame temporally preceding the predetermined frame is calculated. The backlight luminance of the predetermined frame is corrected by using a correction value, which is determined by a coefficient indicating a degree of contribution of the difference to correction of the backlight luminance and by the difference. A transmittance of light from the backlight in the display panel is calculated on the basis of the corrected backlight luminance and the image signal.

Advantageous Effects

According to an aspect of the present invention, an image can be displayed. In particular, according to an aspect of the present invention, deterioration in the image quality of a displayed image can be suppressed.

BEST MODES FOR CARRYING OUT THE INVENTION

Hereinbelow, an embodiment to which the present invention is applied will be described with reference to the drawings.

Figure 1:
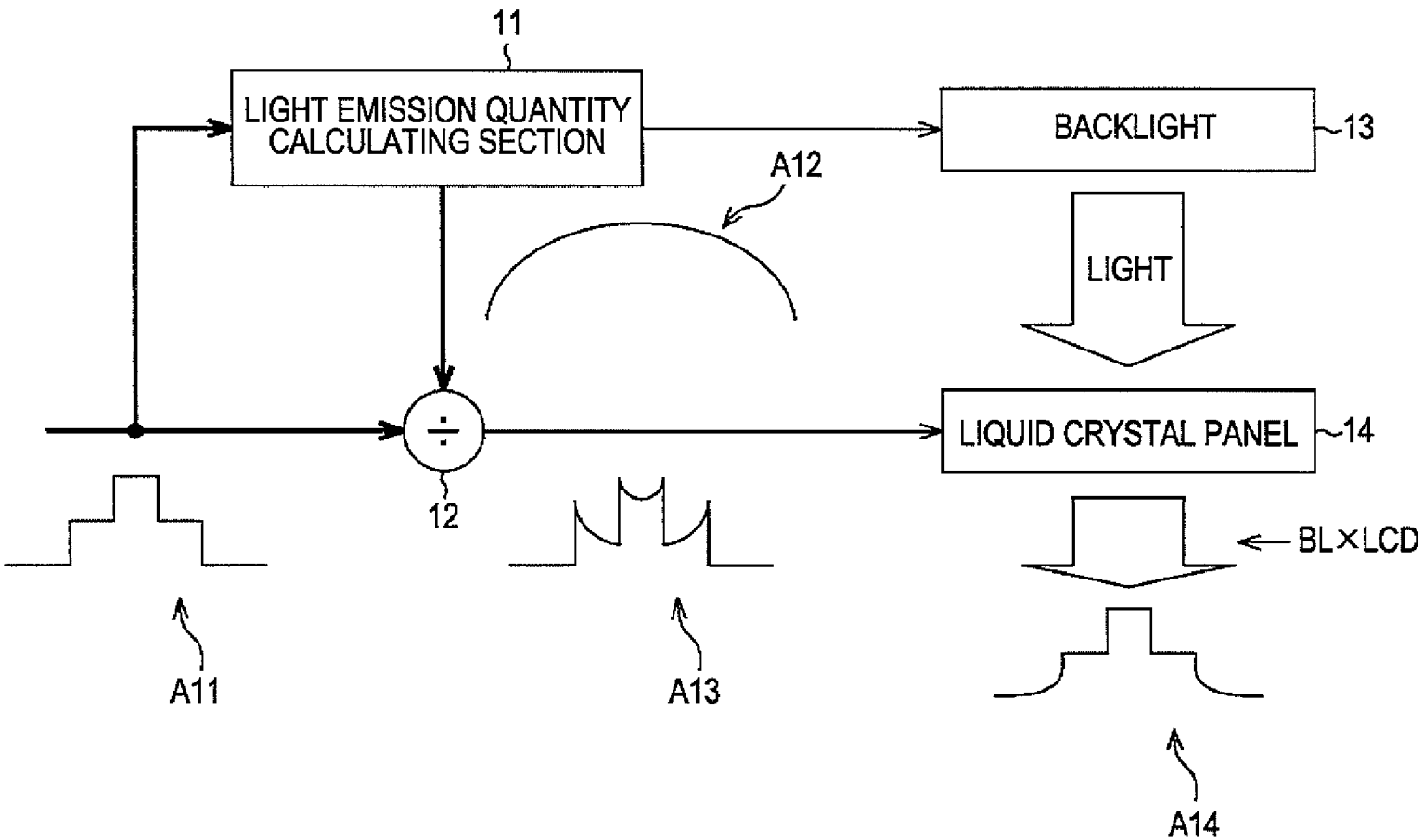
FIG. 1 (RELATED ART)
FIG. 1 is a diagram showing the configuration of a liquid crystal apparatus according to the related art.
Figure 2:
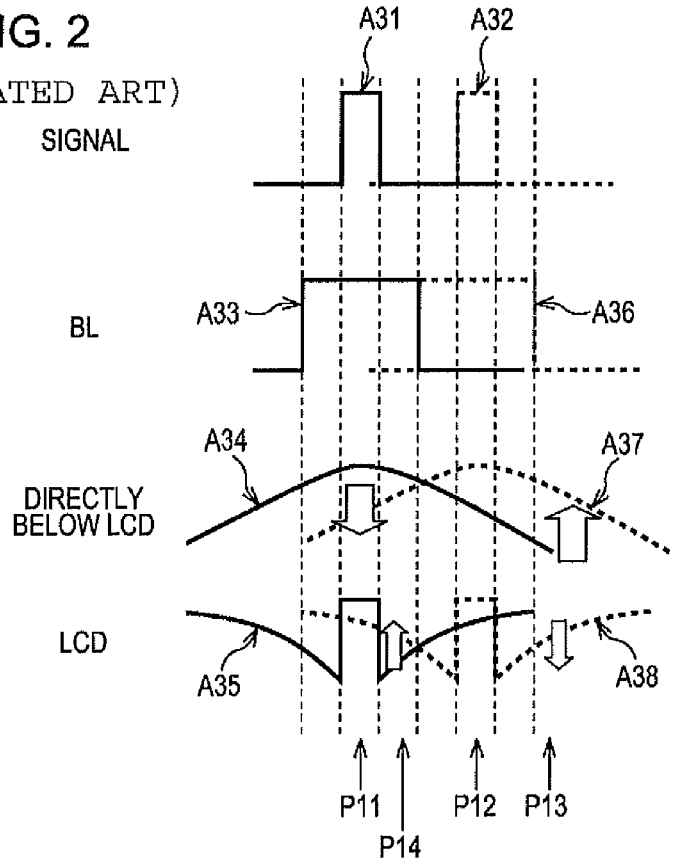
FIG. 2 (RELATED ART)
FIG. 2 is a diagram explaining about deterioration in the image quality of an image in a liquid crystal apparatus according to the related art.
Figure 3:
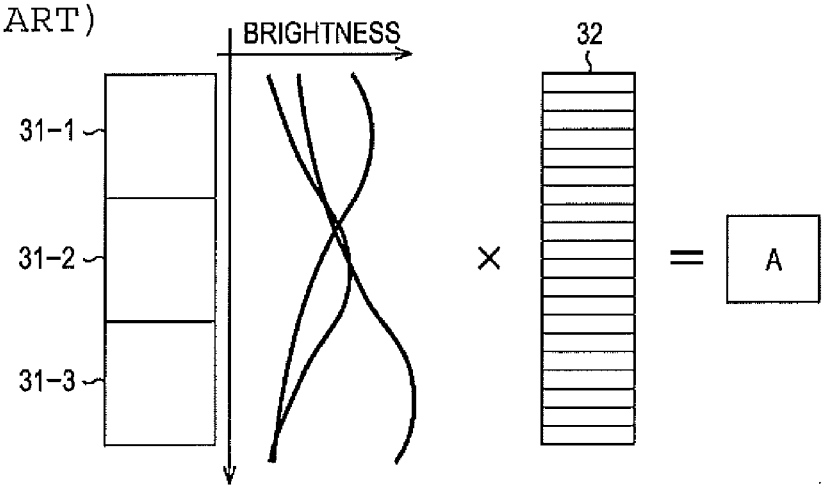
FIG. 3 (RELATED ART)
FIG. 3 is a diagram explaining about deterioration in the image quality of an image in a liquid crystal apparatus according to the related art.
Figure 4:
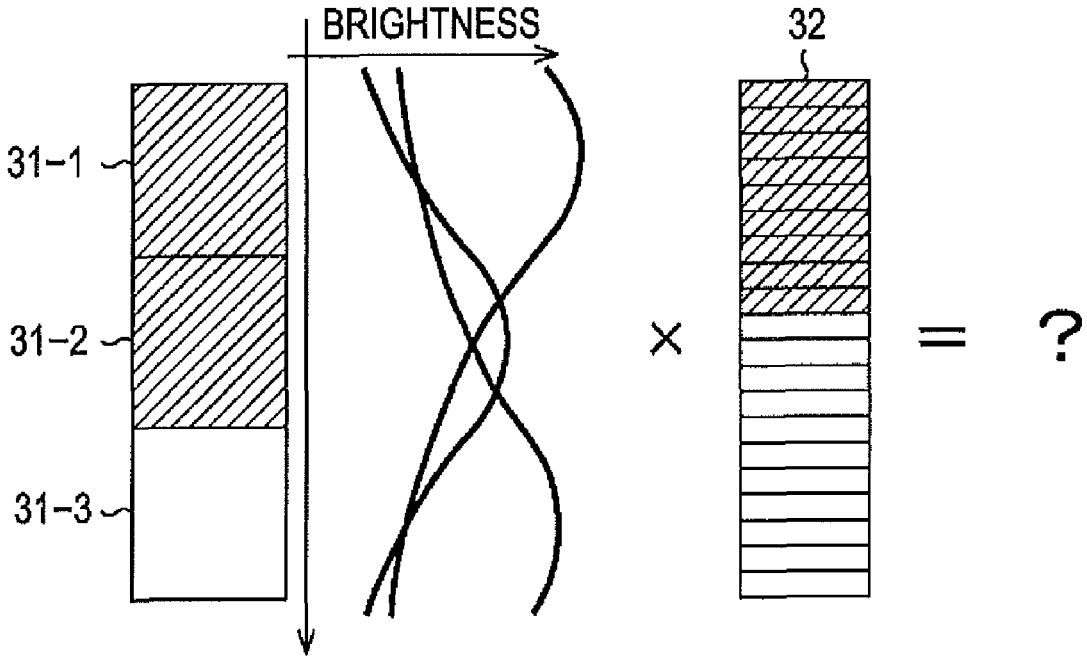
FIG. 4 (RELATED ART)
FIG. 4 a diagram explaining about deterioration in the image quality of an image in a liquid crystal apparatus according to the related art.
Figure 5:
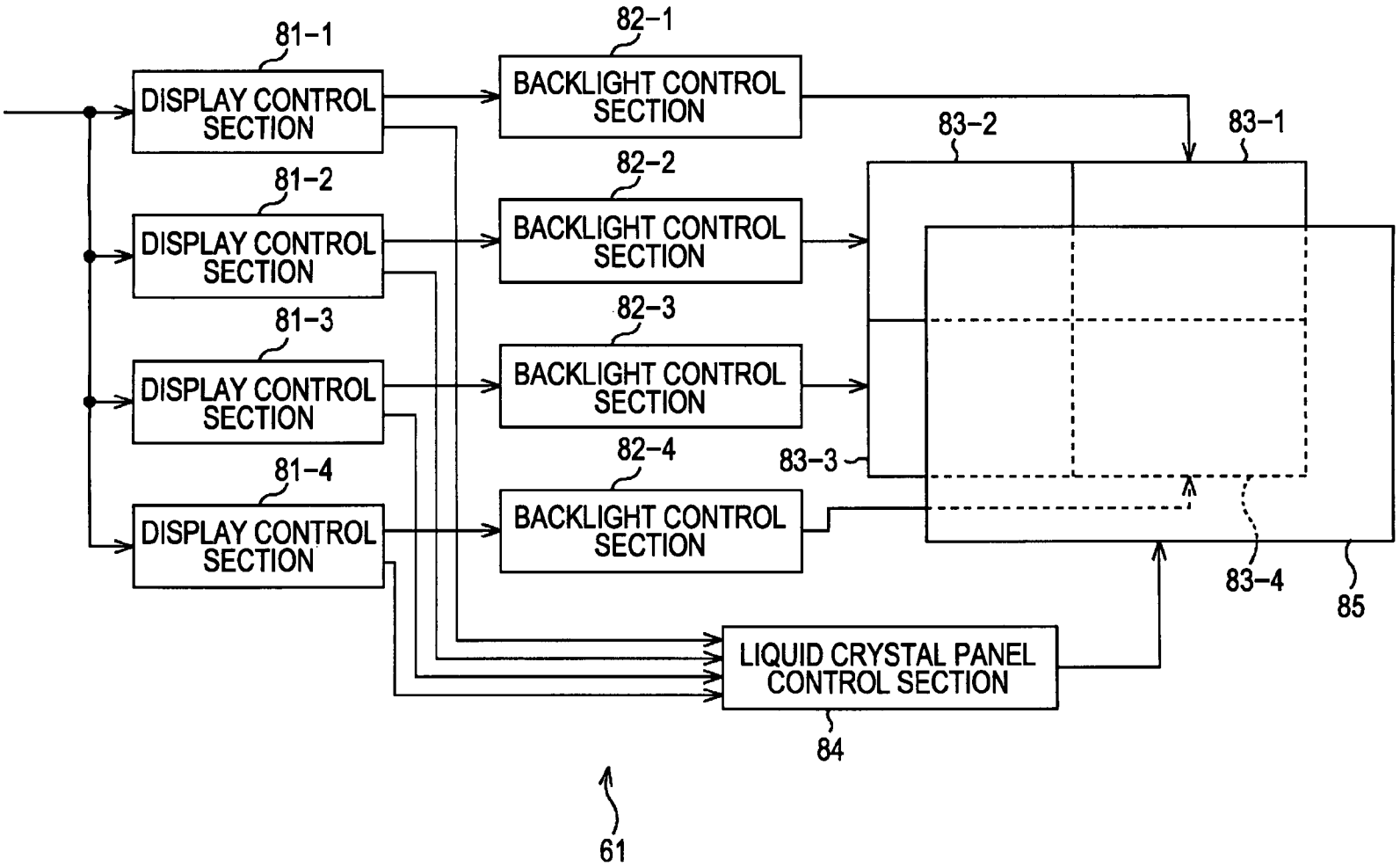
FIG. 5 is a diagram showing a configuration example of an embodiment of a display apparatus to which the present invention is applied.

FIG. 5 is a diagram showing a configuration example of an embodiment of a display apparatus to which the present invention is applied.

A display apparatus 61 includes display control section 81-1 to display control section 81-4, backlight control section 82-1 to backlight control section 82-4, backlight 83-1 to backlight 83-4, a liquid crystal panel control section 84, and a liquid crystal panel 85.

The display apparatus 61 is, for example, a liquid crystal display apparatus such as a liquid crystal display. An image signal of a display image to be displayed on the liquid crystal panel 85 is inputted to the display control section 81-1 to display control section 81-4 of the display apparatus 61.

On the basis of the inputted image signal, the display control section 81-1 to the display control section 81-4 calculate the light quantity of light to be radiated from the backlight 83-1 to the backlight 83-4, more specifically, a backlight luminance indicating the luminance of light, and supplies the backlight luminance to the backlight control section 82-1 to the backlight control section 82-4.

Also, on the basis of the image signal, with respect to each of display regions of the liquid crystal panel 85 on which much of light from each of the backlight 83-1 to the backlight 83-4 is incident, the display control section 81-1 to the display control section 81-4 calculate the transmittance of each pixel within the display region and supplies the transmittance to the liquid crystal panel control section 84. This transmittance takes a value between 0 and 1, for example.

It should be noted that a pixel in the display region of the liquid crystal panel 85 refers to a single cell that serves as a unit of image display, and is made up of each region that transmits each light of R, G, and B.

On the basis of the backlight luminance supplied from the display control section 81-1 to the display control section 81-4, the backlight control section 82-1 to the backlight control section 82-4 control the backlight 83-1 to the backlight 83-4 so as to emit light. Also, in accordance with the control of the backlight control section 82-1 to the backlight control section 82-4, the backlight 83-1 to the backlight 83-4 emit light, and makes the light incident on the liquid crystal panel 85.

The liquid crystal panel control section 84 causes the liquid crystal panel 85 to transmit light at the transmittance of each pixel, that is, aperture ratio, supplied from the display control section 81-1 to the display control section 81-4. The liquid crystal panel 85 transmits light incident on each pixel in the display region from the backlight 83-1 to the backlight 83-4, at the transmittance instructed from the liquid crystal panel control section 84, thereby displaying a display image.

It should be noted that hereinafter, each of the display control section 81-1 to the display control section 81-4 will be simply referred to as display control section 81 in cases where there is no need to individually differentiate between them, and each of the backlight control section 82-1 to the backlight control section 82-4 will be simply referred to as backlight control section 82 in cases where there is no need to individually differentiate between them. Also, hereinafter, each of the backlight 83-1 to the backlight 83-4 will be simply referred to as backlight 83 in cases where there is no need to individually differentiate between them.

In the display apparatus 61, the backlight 83 as a light source is placed on the back surface of the liquid crystal panel 85, and much of the light radiated from the backlight 83 is incident on the display region of the liquid crystal panel 85 opposed to the backlight 83. For example, much of the light radiating from the backlight 83-1 is incident on the portion of the liquid crystal panel 85 located diagonally above to the right in the drawing. Therefore, in the case of displaying an image such that the side of the liquid crystal panel 85 located diagonally above to the right is bright, and the other portion is dark, only the backlight 83-1 can be made to emit light at somewhat high luminance, and the other backlight 83-2 to backlight 83-4 can be made to emit light at relatively low luminance. This makes it possible to suppress consumption of power by the backlight 83, and increase the dynamic range of the luminance of a display image.

It should be noted that while the display apparatus 61 is provided with the transmission type liquid crystal panel 85, not only a liquid crystal panel but any kind of transmission type display panel that displays an image by transmitting light from the backlight 83 may be used.

Figure 6:
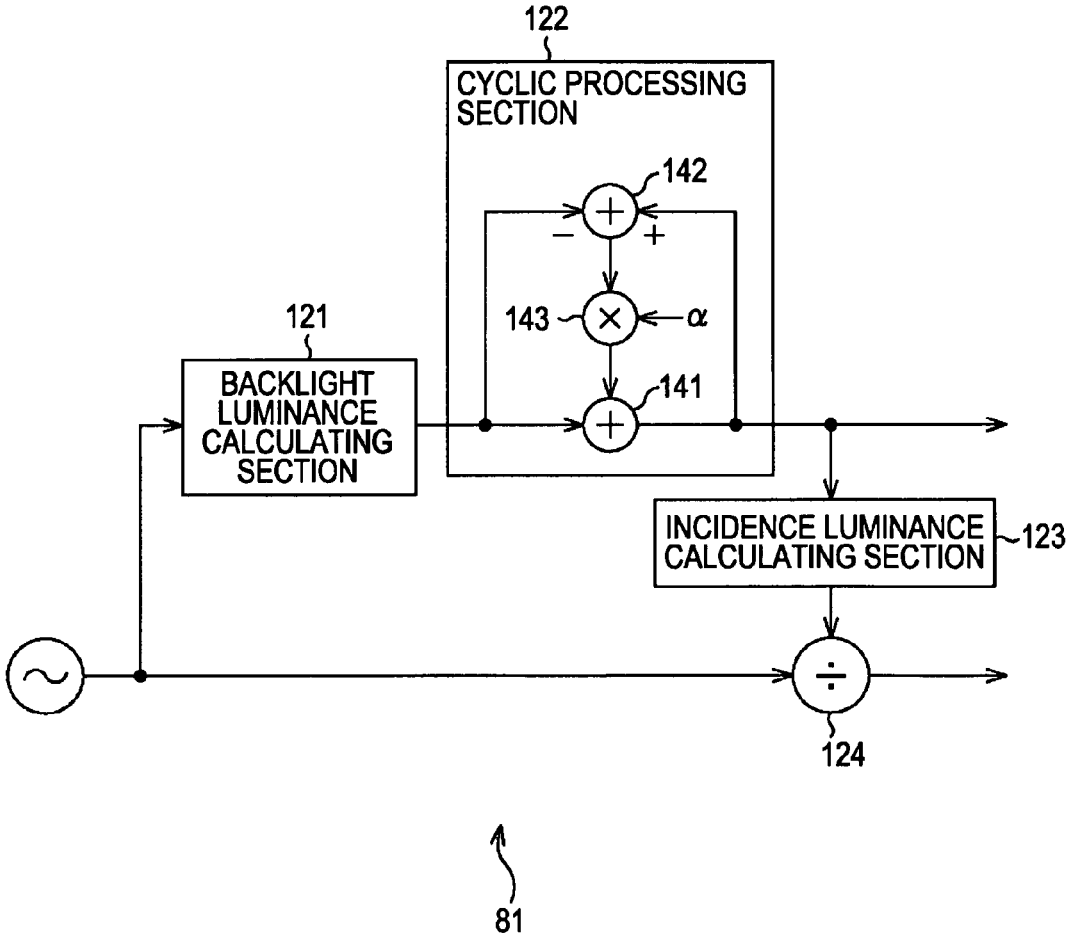
FIG. 6 is a diagram showing a more detailed configuration example of a display control section.

Next, FIG. 6 is a diagram showing a more detailed configuration example of the display control section 81 in FIG. 5.

The display control section 81 includes a backlight luminance calculating section 121, a cyclic processing section 122, an incidence luminance calculating section 123, and a division section 124.

An image signal inputted to the display control section 81 of the display apparatus 61 is supplied to the backlight luminance calculating section 121 and division section 124 of the display control section 81. This image signal is, for example, the image signal of a moving image.

The backlight luminance calculating section 121 calculates the backlight luminance of light to be radiated by the backlight 83, on the basis of the supplied image signal, and supplies the backlight luminance to the cyclic processing section 122.

For example, on the basis of an image signal, the backlight luminance calculating section 121 finds the maximum value of luminances of pixels in a region on a display image based on the image signal which is a region displayed in the display region of the liquid crystal panel 85 corresponding to the backlight 83. Then, on the basis of the maximum value found, the backlight luminance calculating section 121 finds the backlight luminance of light to be radiated by the backlight 83.

It should be noted that the display region of the liquid crystal panel 85 corresponding to the backlight 83 refers to a region which is obtained by virtually splitting the entire display region of the liquid crystal panel 85 and on which the majority of light from each single backlight 83 directly below the back surface of the liquid crystal panel 85 is incident.

For example, supposing that the display region of the liquid crystal panel 85 is virtually split in four, into upper right, upper left, lower left, and lower right regions, display regions respectively corresponding to the backlight 83-1 to the backlight 83-4 are the upper right, upper left, lower left, and lower right regions on the display region. Hereinafter, a display region of the liquid crystal panel 85 corresponding to the backlight 83 will be also referred to as partial display region.

The cyclic processing section 122 performs cyclic processing, and corrects the backlight luminance of a display image of a predetermined frame to be displayed from now on, which is supplied from the backlight luminance calculating section 121, on the basis of the backlight luminance of a display image of a frame that temporally precedes the predetermined frame. The cyclic processing section 122 includes an addition section 141, a subtraction section 142, and a multiplication section 143.

The backlight luminance from the backlight luminance calculating section 121 is supplied to the addition section 141 and the subtraction section 142. The addition section 141 adds a correction value supplied from the multiplication section 143, to the backlight luminance supplied from the backlight luminance calculating section 121 to thereby correct the backlight luminance, and supplies the corrected backlight luminance to the subtraction section 142, the backlight control section 82, and the incidence luminance calculating section 123.

The subtraction section 142 subtracts the backlight luminance supplied from the backlight luminance calculating section 121, from the backlight luminance supplied from the addition section 141, and supplies the subtraction result to the multiplication section 143. That is, the subtraction section 142 finds the difference between the backlight luminance of a predetermined frame to be displayed from now on, and the backlight luminance of a frame immediately preceding the predetermined frame, and supplies the difference found to the multiplication section 143.

The multiplication section 143 multiplies the difference supplied from the subtraction section 142, by an inputted cyclic coefficient, and supplies the difference multiplied by the cyclic coefficient to the addition section 141 as a correction value. Here, a cyclic coefficient is a coefficient indicating the degree of contribution of the backlight luminance of the immediately preceding frame, that is, the difference from the subtraction section 142, to the correction of the backlight luminance of a predetermined frame to be displayed. This cyclic coefficient is set as a previously determined constant, or a constant that is varied by the user as appropriate, and is a coefficient of a value from 0 to 1.

Therefore, for example, when the cyclic coefficient is 1, in the addition section 141, the difference from the subtraction section 142 is added to the backlight luminance as it is, so the corrected backlight luminance becomes the same value as the backlight luminance of the immediately preceding frame. Also, as the cyclic coefficient becomes smaller, the correction value becomes smaller, and the value of the backlight luminance after the correction becomes closer to the backlight luminance before the correction. Then, when, for example, the cyclic coefficient becomes zero, in the addition section 141, the difference from the subtraction section 142 is not added to the backlight luminance, and the backlight luminance is outputted as it is.

On the basis of the backlight luminance supplied from the addition section 141 of the cyclic processing section 122, the incidence luminance calculating section 123 calculates a pixel incidence luminance indicating the luminance of light estimated to be incident on a pixel from the backlight 83, with respect to each pixel in the partial display region of the liquid crystal panel 85 corresponding to the backlight 83. That is, a pixel incidence luminance represents information indicating the luminance of light estimated to be incident on a pixel in the partial display region from the backlight 83, in the case when the backlight 83 emits light at the supplied backlight luminance.

For example, the incidence luminance calculating section 123 holds in advance a profile indicating how light radiated from the backlight 83 is diffused when the corresponding backlight 83 emits light. Then, by using the held profile, the incidence luminance calculating section 123 finds the luminances of light estimated to be incident from the backlight 83 on individual pixels in the partial display region of the liquid crystal panel 85 corresponding to the backlight 85, when the backlight 83 emits light at the backlight luminance supplied from the addition section 141, and sets those pixel-by-pixel luminances as pixel incidence luminances.

Upon finding the pixel incidence luminances at individual pixels in the partial display region, the incidence luminance calculating section 123 supplies those pixel incidence luminances to the division section 124.

The division section 124 divides the signal value of a supplied image signal, more specifically a luminance found from the signal value, by the pixel incidence luminances from the incidence luminance calculating section 123, thereby calculating the transmittances of individual pixels in the partial display region. Then, the division section 124 supplies the calculated pixel-by-pixel transmittances to the liquid crystal panel control section 84.

For example, let a targeted pixel in a partial display region be referred to as target pixel. Also, let the pixel incidence luminance of the target pixel be CL, the backlight luminance of the backlight 83 be BL, and the luminance of a pixel on a display image located at the same position as the target pixel, that is, a pixel on a display image in which an image displayed by the target pixel is displayed, be IL. Further, let the transmittance of light at the target pixel be T.

In this case, when the backlight 83 is made to emit light at backlight luminance BL, the luminance of light incident on the target pixel from the backlight 83, that is, the pixel incidence luminance of the target pixel is CL. Then, when the target pixel transmits, at transmittance T, the light of pixel incidence luminance CL incident from the backlight 83, the luminance of light radiated from the target pixel, that is, the luminance of the target pixel as perceived by the user looking at the liquid crystal panel 85 (hereinafter, also referred to as display luminance OL) is represented by pixel incidence luminance CL×transmittance T. If display luminance OL is equal to luminance IL of a pixel in a display image, the same image as the display image is displayed on the liquid crystal panel 85. Hence, supposing that display luminance OL and luminance IL are equal, Equation (1) below holds.

$$\text{Transmittance } T = (\text{luminance } IL \text{ of a pixel in a display image})/(\text{pixel incidence luminance } CL) \quad (1)$$

Therefore, the division section 124 can calculate appropriate transmittance T of the target pixel by dividing the signal value of an image signal representing the pixel value of a pixel in a display image corresponding to the target pixel, more specifically, luminance IL of the pixel in the display image, by pixel incidence luminance CL of the target pixel supplied from the incidence luminance calculating section 123.

Figure 7:
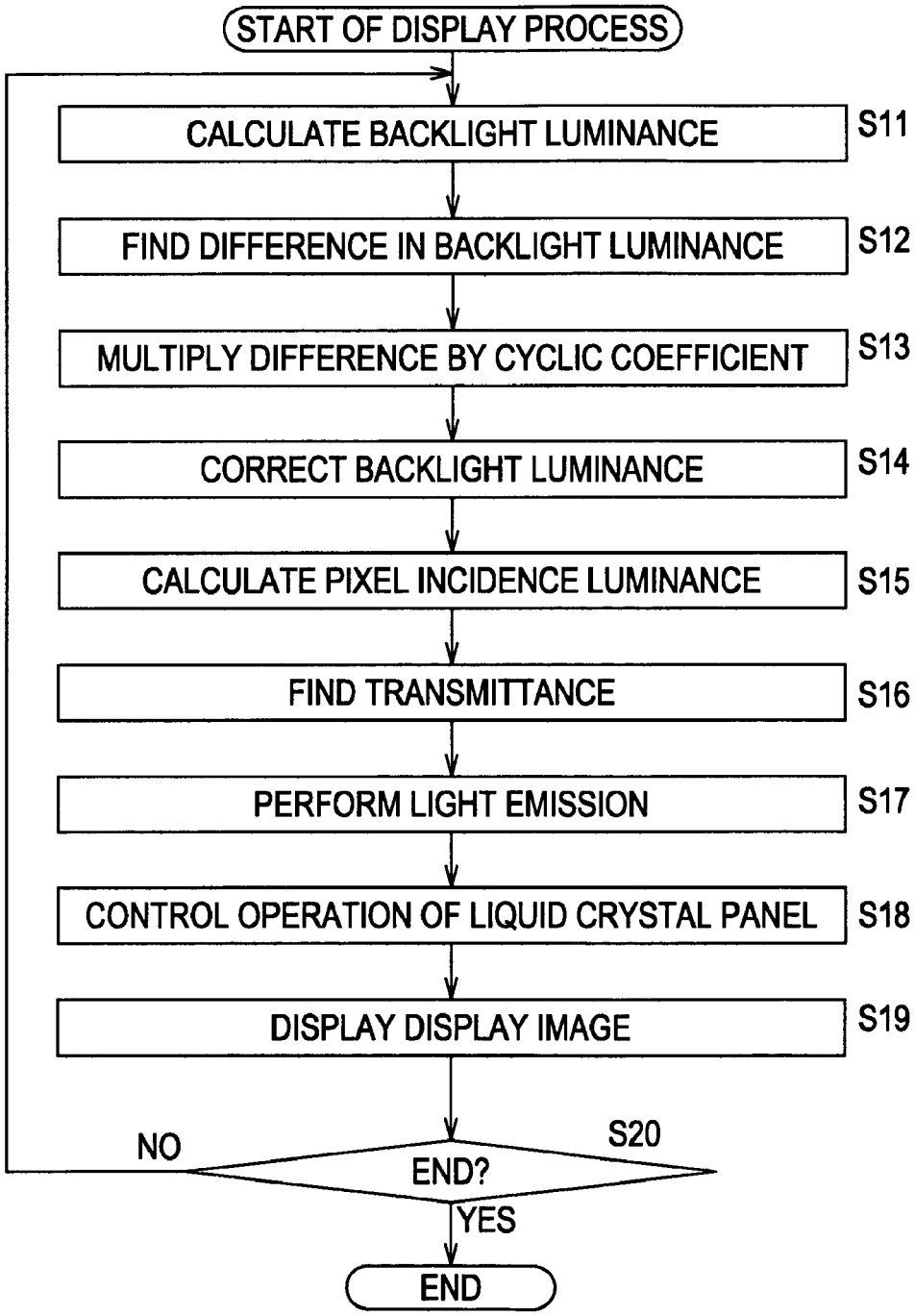
FIG. 7 is a flowchart explaining a display process.

Incidentally, when the image signal of a display image such as a moving image is supplied to the display apparatus 61, and displaying of the display image is instructed, in response to the instruction, the display apparatus 61 starts a display process of displaying the display image. Hereinafter, the display process by the display apparatus 61 will be described with reference to the flowchart in FIG. 7.

In step S11, the backlight luminance calculating section 121 calculates the backlight luminance of the backlight 83 on the basis of an inputted image signal, and supplies the calculated backlight luminance to the addition section 141 and the subtraction section 142.

In step S12, the subtraction section 142 founds the difference between a backlight luminance supplied from the addition section 141, and the backlight luminance supplied from the backlight luminance calculating section 121, and supplies the found difference to the multiplication section 143.

In step S13, the multiplication section 143 multiples the difference supplied from the subtraction section 142, by an inputted cyclic coefficient to find a correction value, and supplies the found correction value to the addition section 141.

In step S14, the addition section 141 adds the correction value supplied from the multiplication section 143, to the backlight luminance supplied from the backlight luminance calculating section 121, thereby correcting the backlight luminance. Then, the addition section 141 supplies the corrected backlight luminance to the subtraction section 142, the incidence luminance calculating section 123, and the backlight control section 82.

In step S15, on the basis of the backlight luminance supplied from the addition section 141, the incidence luminance calculating section 123 calculates a pixel incidence luminance for each of pixels in the partial display region of the liquid crystal panel 85 corresponding to the backlight 83. The incidence luminance calculating section 123 supplies the calculated pixel incidence luminance to the division section 124.

In step S16, the division section 124 divides a supplied image signal by the pixel incidence luminance supplied from the incidence luminance calculating section 123, thereby finding the transmittance of a pixel for each of pixels in the partial display region, and supplies the transmittance to the liquid crystal panel control section 84.

In step S17, on the basis of the backlight luminance supplied from the addition section 141, the backlight control section 82 causes the backlight 83 to emit light at the backlight luminance. Also, the backlight 83 emits light on the basis of control of the backlight control section 82, and makes light having the specified backlight luminance incident on the liquid crystal panel 85.

It should be noted that the processes in step S11 to step S16 described above are individually performed by each of the display control section 81-1 to the display control section 81-4. Also, the process in step S17 is performed individually by each of the backlight control section 82-1 to the backlight control section 82-4, and each of the backlight 83-1 to the backlight 83-4.

In step S18, the liquid crystal panel control section 84 controls the operation of the liquid crystal panel 85, on the basis of the transmittance for each pixel in the display region of the liquid crystal panel 85 which is supplied from the display control section 81, and changes the transmittance of each pixel.

In step S19, on the basis of control of the liquid crystal panel control section 84, the liquid crystal panel 85 changes the transmittance of each pixel in the display region to the transmittance specified on a pixel-by-pixel basis, and transmits light incident from the backlight 83, thereby displaying a display image.

In step S20, the display apparatus 61 determines whether or not to end the display of the display image. For example, it is determined to end the display if ending of the display of the display image has been instructed by the user, or if the display images of all the frames of a supplied image signal have been displayed.

If it is determined in step S20 not to end the display of the display image, the processing returns to step S11, and the above-described processes are repeated. That is, the backlight luminance and the transmittance are found with respect to a display image of the next frame, and the display image is displayed.

In contrast, if it is determined in step S20 to end the display of the display image, each section of the display apparatus 61 ends a process being performed, and the display process ends.

In this way, when an image signal is supplied, the display apparatus 61 finds the backlight luminance and the transmittance and displays a display image.

According to the display apparatus 61, the difference between the backlight luminance of a frame to be displayed, and the backlight luminance of the immediately preceding frame is found, and the difference and a cyclic coefficient are used to perform correction of the backlight luminance.

Therefore, the backlight luminance does not change abruptly even when the luminance of a display image changes abruptly. That is, the backlight luminance changes gradually at a rate corresponding to the cyclic coefficient. Thus, abrupt switching of displays can be mitigated, and it is possible to suppress deterioration in the image quality of an image which occurs due to a difference in response speed between the backlight 83 and the liquid crystal panel 85, or deterioration in the image quality of an image which occurs due to asynchronism between changing of backlight luminance in the backlight 83 and changing of transmittance of pixels in the liquid crystal panel 85. As a result, a higher quality display image can be displayed.

It should be noted that while it has been described in the foregoing that the backlight luminance and the transmittance are calculated and varied for each frame of a display image, in cases where the display image is displayed in modes other than the progressive mode, the backlight luminance and the transmittance are calculated and varied for each unit of display switching (display unit) such as a field or sub-field.

Also, it has been described that in the incidence luminance calculating section 123, the pixel incidence luminance at each pixel is calculated on the basis of the backlight luminance of light from each single backlight 83. However, in actuality, light is incident on a partial display region not only from the corresponding backlight 83 but also from the other backlights 83. Accordingly, in the incidence luminance calculating section 123, the backlight luminance of the corresponding backlight 83 and the backlight luminances of the other backlights 83 may be used to calculate the pixel incidence luminance.

Further, it has been described in the foregoing that the cyclic coefficient inputted to the multiplication section 143 is a previously determined constant, or a constant that is changed by the user as appropriate. In this case, depending on the value of a cyclic coefficient that is set, a situation can arise in which when the display image abruptly changes, there is a delay in the light from the backlight 83 reaching a desired brightness (backlight luminance), or the light from the backlight 83 does not readily become dark even when the display image becomes dark.

Figure 8:
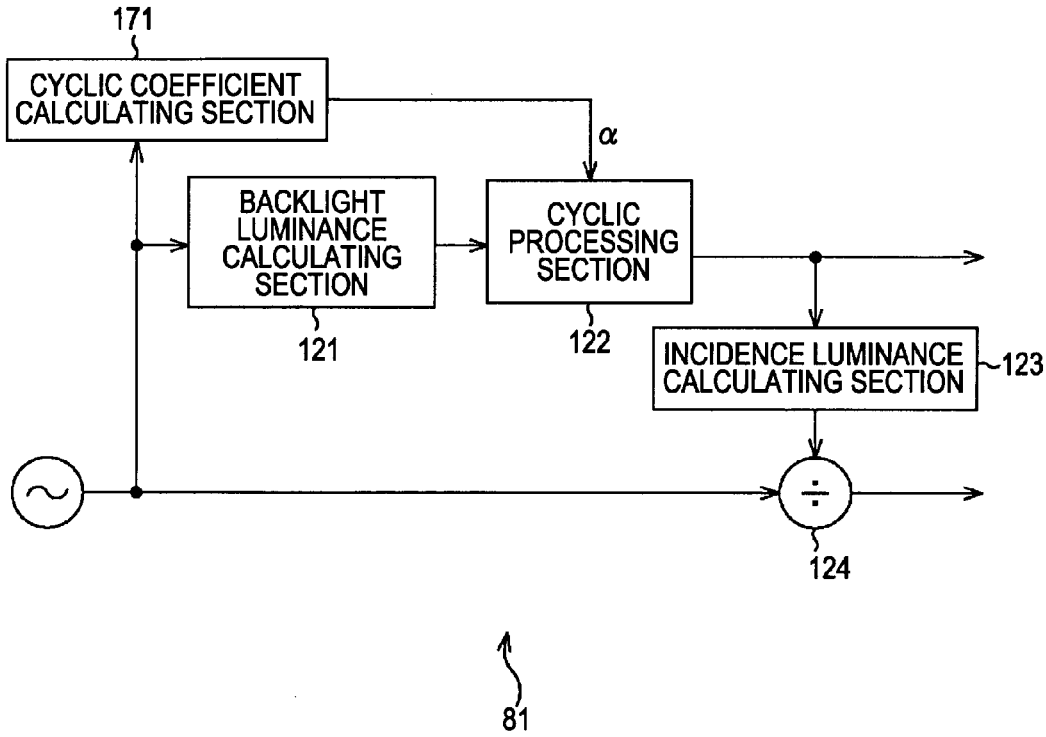
FIG. 8 is a diagram showing another configuration example of a display control section.

Accordingly, the cyclic coefficient may be changed dynamically in accordance with the state of the display image so that the cyclic coefficient becomes an appropriate value. In such a case, the display control section 81 is configured as shown in FIG. 8, for example. It should be noted that in FIG. 8, portions corresponding to those in the case in FIG. 6 are denoted by the same reference numerals, and description thereof is omitted.

In the display control section 81 in FIG. 8, the display control section 81 in FIG. 6 is further provided with a cyclic coefficient calculating section 171. An image signal inputted to the display control section 81 is supplied to the backlight luminance calculating section 121, the division section 124, and the cyclic coefficient calculating section 171.

The cyclic coefficient calculating section 171 calculates a cyclic coefficient on the basis of a supplied image signal, and supplies the calculated cyclic coefficient to the cyclic processing section 122. Thus, the cyclic efficient is dynamically changed to an appropriate value in accordance with the image signal, thereby making it possible to further suppress deterioration in the image quality of a display image.

Figure 9:
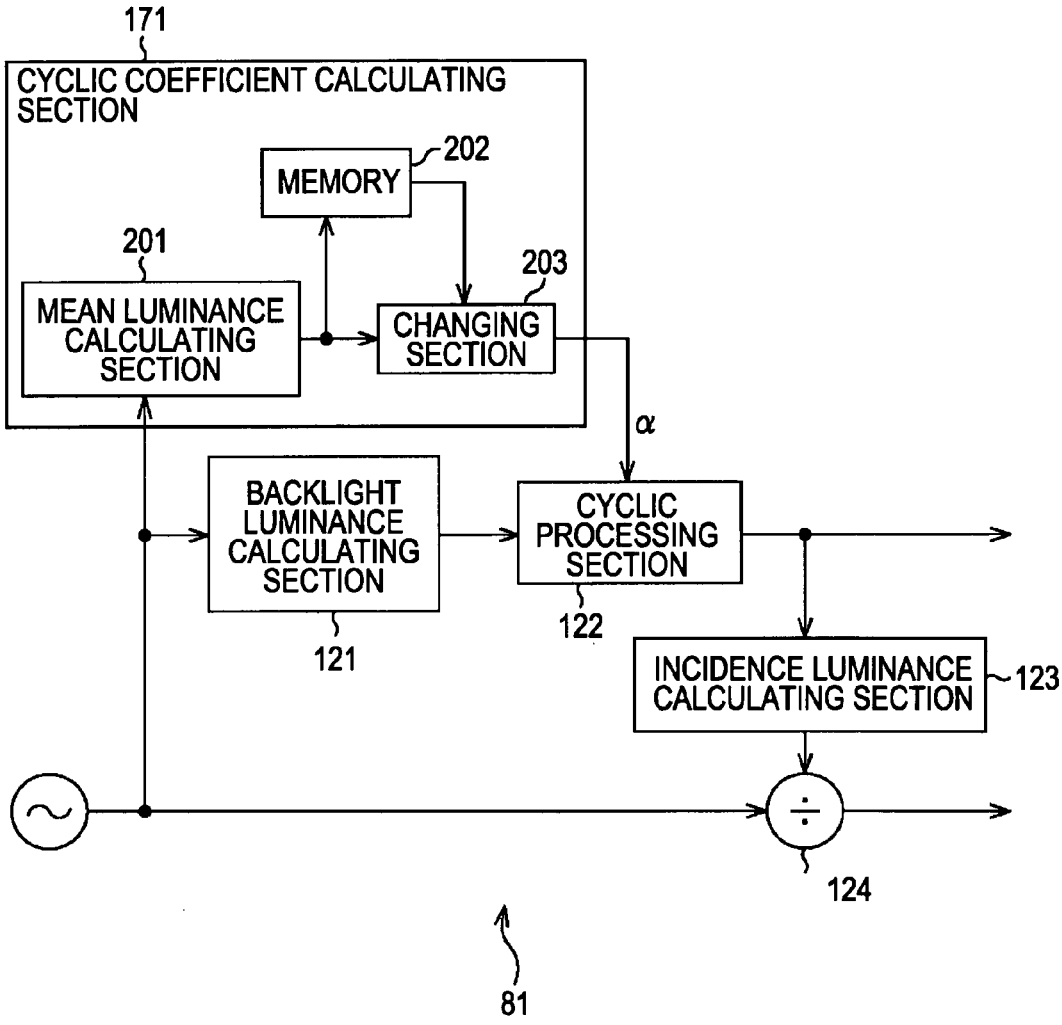
FIG. 9 is a diagram showing another configuration example of a display control section.

More specifically, as shown in FIG. 9, for example, the cyclic coefficient calculating section 171 includes a mean luminance calculating section 201, a memory 202, and a changing section 203.

The mean luminance calculating section 201 calculates the mean of the luminances of pixels in a display image on the basis of a supplied image signal, thereby calculating the mean luminance of the display image. Then, the mean luminance calculating section 201 supplies the calculated mean luminance to the memory 202 and the changing section 203.

The memory 202 holds the mean luminance supplied from the mean luminance calculating section 201 for a period of time equivalent to one frame of the display image, and thereafter supplies the mean luminance to the changing section 203. The changing section 203, which holds a cyclic coefficient, calculates the difference between the mean luminance supplied from the mean luminance calculating section 201, and the mean luminance supplied from the memory 202, and changes the cyclic coefficient on the basis of the calculated difference. Upon changing the held cyclic coefficient, the changing section 203 supplies the changed cyclic coefficient to the cyclic processing section 122.

Figure 10:
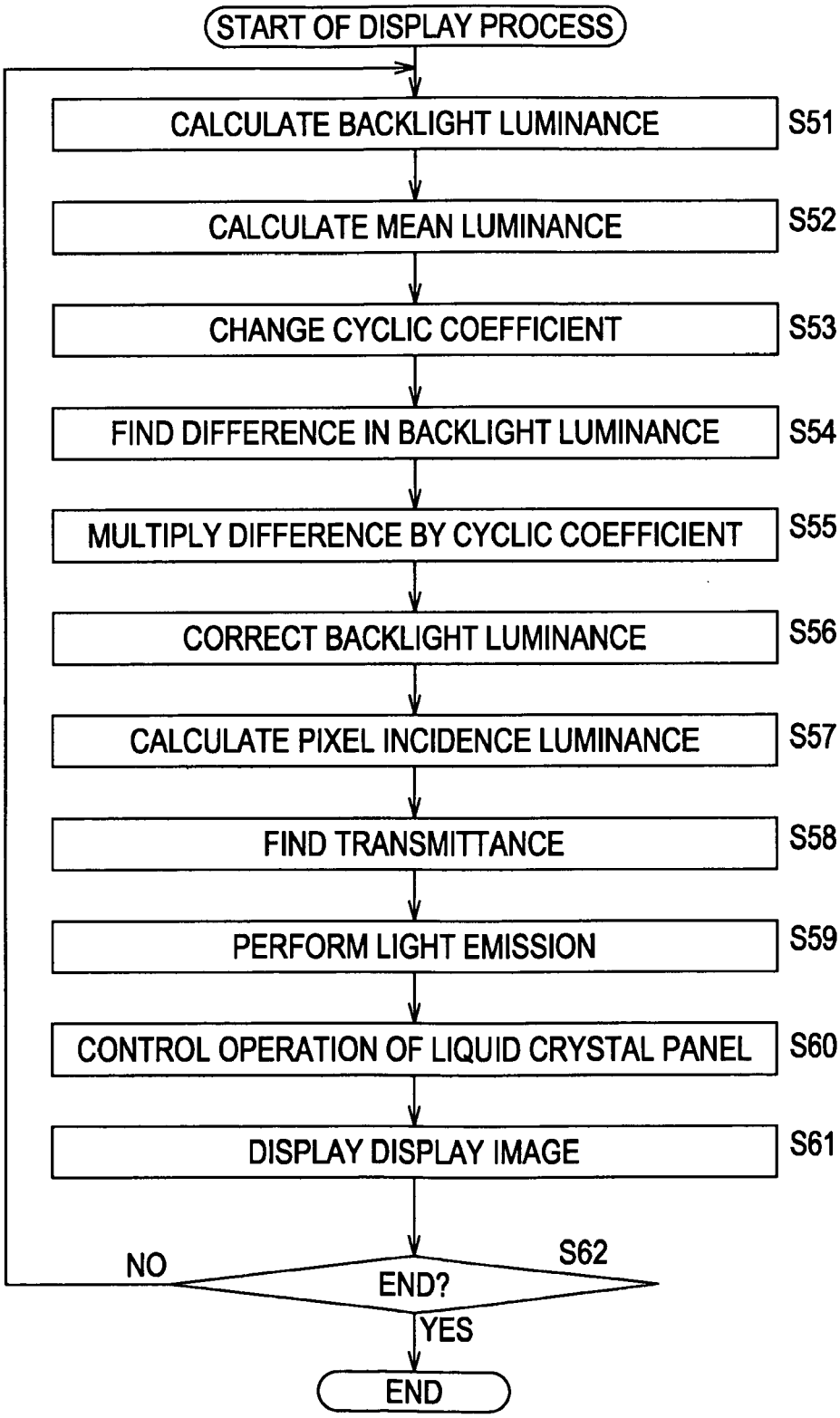
FIG. 10 is a flowchart explaining a display process.

Next, referring to the flowchart in FIG. 10, a description will be given of a display process in the case where the display control section 81 is configured as in FIG. 9.

In step S51, the backlight luminance calculating section 121 calculates a backlight luminance on the basis of a supplied image signal, and supplies the calculated backlight luminance to the addition section 141 and subtraction section 142 of the cyclic processing section 122.

In step S52, the mean luminance calculating section 201 calculates the mean luminance of a display image on the basis of the supplied image signal, and supplies the mean luminance to the memory 202 and the changing section 203. For example, with respect to individual pixels in a display image of a predetermined frame to be displayed from now on, the mean luminance calculating section 201 calculates the luminances of the pixels on the basis of the image signal, and further divides the sum of the calculated luminances of the pixels by the number of pixels in the display image, thereby calculating the mean luminance of the display image of the predetermined frame. Also, the memory 202 supplies the held mean luminance to the changing section 203, and holds the mean luminance supplied from the mean luminance calculating section 201 for a period of time equivalent to one frame.

In step S53, the changing section 203 changes the cyclic coefficient from the mean luminance supplied from the mean luminance calculating section 201, and the mean luminance supplied from the memory 202.

For example, the changing section 203 subtracts the mean luminance of a frame that immediately precedes the predetermined frame temporally, from the mean luminance of the predetermined frame supplied from the mean luminance calculating section 201, thereby finding a difference in mean luminance. Then, the changing section 203 adds a value that is determined in accordance with the value of the found difference, to the held cyclic coefficient, thereby changing the cyclic coefficient.

Here, the value that is determined in accordance with the value of the difference is, for example, a value obtained by dividing the value of the difference by the larger mean luminance in absolute value of the mean luminances of the predetermined frame and of the preceding frame. Also, for example, the changing section 203 may change the cyclic coefficient by adding a constant that is previously determined with respect to the value of the difference in mean luminance, to the held cyclic coefficient.

Upon changing the cyclic coefficient, the changing section 203 supplies the changed cyclic coefficient to the multiplication section 143 of the cyclic processing section 122. Thereafter, a process in step S54 to a process in step S62 are performed. Since these processes are the same as the process in step S12 to the process in step S20 in FIG. 7, description thereof is omitted.

In this way, the display apparatus 61 calculates the mean luminance of a display image on the basis of an image signal, and dynamically changes the cyclic coefficient by using the calculated mean luminance.

By dynamically changing the cyclic coefficient by using the mean luminance of the display image in this way, it is possible to suppress an abrupt change in backlight luminance and, as a result, suppress deterioration in the image quality of the display image. Also, since the cyclic coefficient is appropriately changed in accordance with a change in the mean luminance of the display image, a situation does not arise in which variations in backlight luminance are suppressed so much that the backlight luminance becomes insufficient. In particular, changing the cyclic coefficient by using the mean luminance is effective for suppressing deterioration in the image quality of the display image in cases where the backlight luminance varies abruptly due to a scene change in the display image.

For example, in a case when the entire display image switches over from a bright scene to a dark scene, if the cyclic coefficient is large, that is, if the degree of contribution of the preceding frame to correction of the backlight luminance is large, the backlight luminance changes relatively gently. Therefore, even when the entire display image has become a dark scene, the display image that is actually displayed remains to be displayed brightly for a while.

In the cyclic coefficient calculating section 171, the difference in mean luminance between frames that temporally precede and succeed each other, and a value that is determined in accordance with the value of the difference is added to the cyclic coefficient. Then, the value added to the cyclic coefficient is, for example, a value obtained by dividing the difference by the larger mean luminance in absolute value. In this case, as the mean luminance becomes smaller with time, the cyclic coefficient decreases, and as the mean luminance becomes larger, the cyclic coefficient increases. That is, when the display image switches over from a bright scene to a dark scene, the cyclic coefficient decreases, and conversely, when the display image switches over from a dark scene to a bright scene, the cyclic coefficient increases.

Therefore, in the case when, for example, the entire display image switches over from a bright scene to a dark scene, the cyclic coefficient decreases, the degree of contribution of the preceding frame to correction of the backlight luminance becomes smaller, and the backlight luminance is corrected so as to reach a desired luminance relatively fast. Since the backlight luminance is corrected in this case as well, the backlight luminance is changed so as to reach a desired luminance more quickly while having its abrupt change suppressed, thereby suppressing deterioration in the image quality of the display image.

It should be noted that in the case where the cyclic coefficient is changed in accordance with the difference in mean luminance between display images, when the absolute value of the difference is equal to or above a predetermined threshold, it is regarded that there has been a scene change, and the cyclic coefficient is set smaller, thereby making it possible to more effectively suppress deterioration in image quality that occurs due to a scene change.

Also, the cyclic coefficient may be changed in accordance with the area of a white portion in a display image. For example, if the backlight luminance is raised abruptly in cases where a black dot on a display image changes to a white dot, when a white small dot is flashing on a black background as in the case of a scene in which a star is flashing, there is a fear that the black portion of the display image is affected by the abrupt change in backlight luminance, resulting in deterioration in the image quality of the display image. Conversely, for example, in cases where a white large object appears on a black background, when the backlight luminance is corrected in such a way that the backlight luminance hardly changes, the entire display image becomes dark.

Accordingly, in the case where the area of a white region on a display image is small, it is regarded that no major white object is present on the display image, and the cyclic coefficient is set larger so that an abrupt change in backlight luminance is suppressed. In the case where the area of a white region on a display image is large, it is regarded that a major white object is present on the display image, and the cyclic coefficient is set smaller so that the backlight luminance changes relatively greatly. Thus, deterioration in the image quality of the display image can be suppressed.

Figure 11:
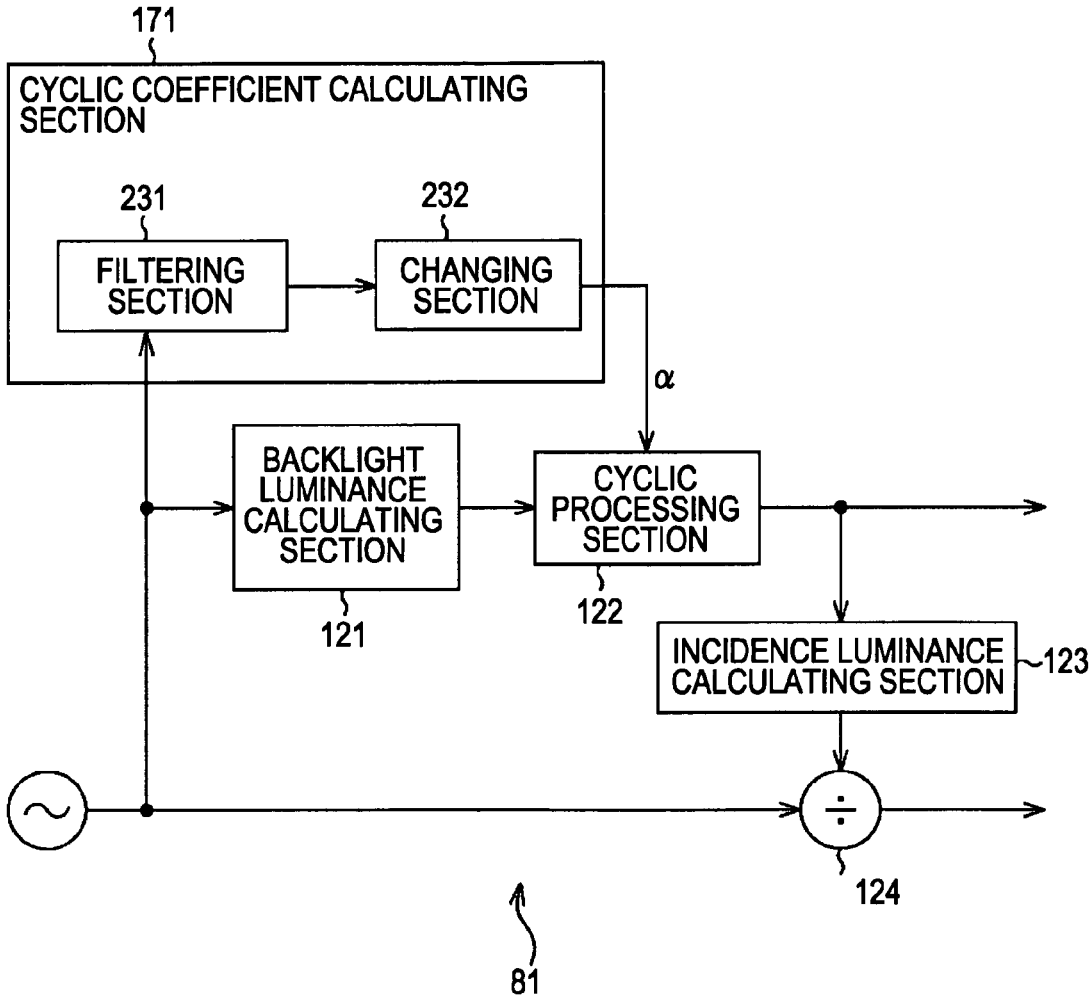
FIG. 11 is a diagram showing another configuration example of a display control section.

In the case where the cyclic coefficient is changed in accordance with the area of a white region on a display image in this way, as shown in FIG. 11, for example, the cyclic coefficient calculating section 171 in FIG. 8 is configured to include a filtering section 231 and a changing section 232.

The filtering section 231 applies filtering to a supplied image signal by using a low-pass filter, and supplies the filtered image signal to the changing section 232. On the basis of the image signal supplied from the filtering section 231, the changing section 232 calculates a value indicating the area of a white region in a display image, more specifically, a region on the display image corresponding to a partial display region, and changes the held cyclic coefficient on the basis of the calculated value. The changing section 232 supplies the changed cyclic coefficient to the cyclic processing section 122.

Here, a white region on a display image refers to a region made up of pixels whose pixel values are equal to or above a predetermined value that is determined in advance.

Figure 12:
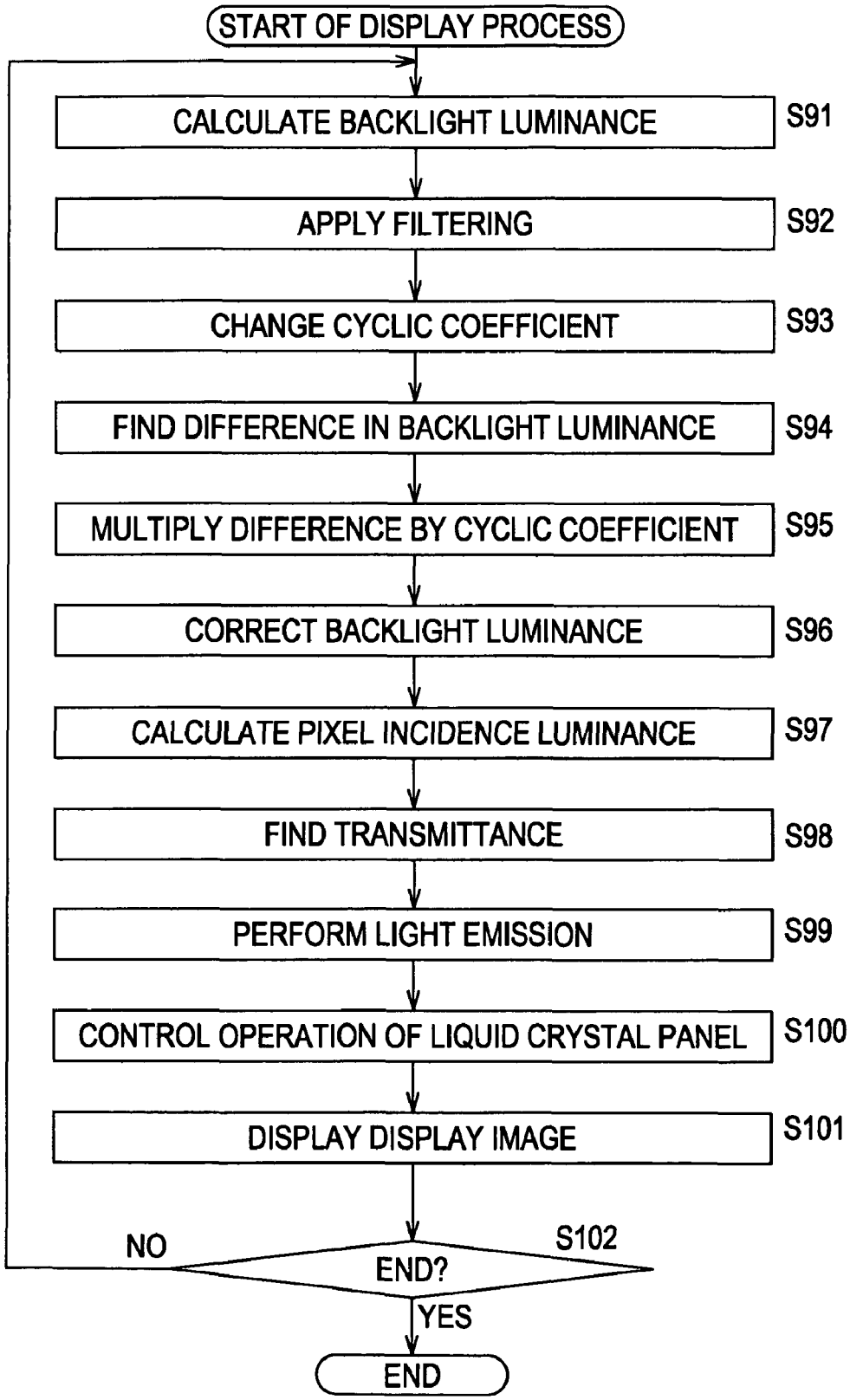
FIG. 12 is a flowchart explaining a display process.

Next, referring to the flowchart in FIG. 12, a description will be given of a display process in the case where the display control section 81 is configured as in FIG. 11.

In step S91, the backlight luminance calculating section 121 calculates a backlight luminance on the basis of a supplied image signal, and supplies the calculated backlight luminance to the addition section 141 and subtraction section 142 of the cyclic processing section 122.

In step S92, the filtering section 231 applies filtering using a low-pass filter to a supplied image signal, and supplies the filtered image signal to the changing section 232.

In step S93, the changing section 232 changes the cyclic coefficient on the basis of the image signal supplied from the filtering section 231.

Figure 13:
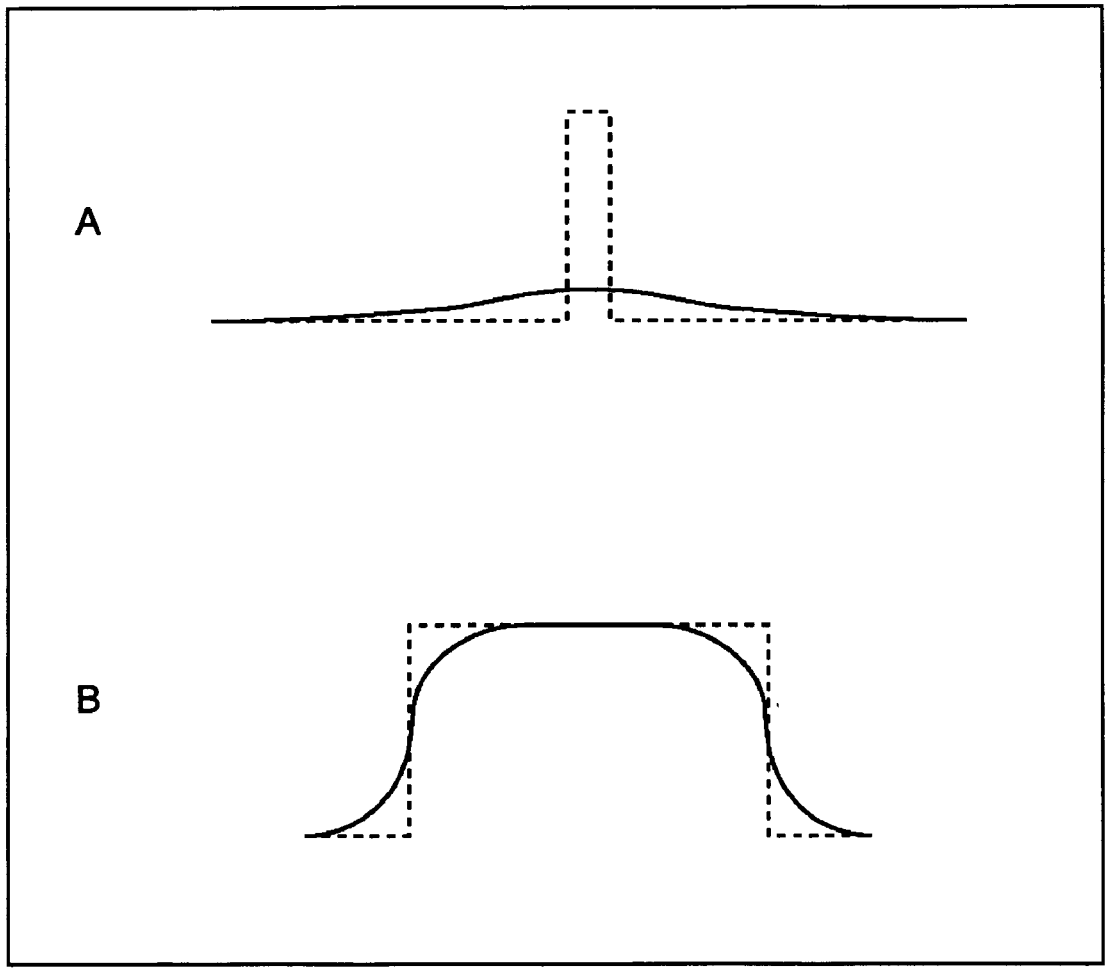
FIG. 13 is a diagram explaining the area of a white region on a display image.

For example, as shown in A of FIG. 13, in the case where the area of a white region on a display image is small, when filtering is applied by a low-pass filter, the pixel value of the white region becomes significantly smaller. In contrast, as shown in B of FIG. 13, in the case where the area of a white region on a display image is large, even when filtering is applied by a low-pass filter, the pixel value of the white region hardly changes.

It should be noted that in A of FIG. 13 and B of FIG. 13, the vertical direction indicates the pixel value (luminance) of a pixel in a display image, and the horizontal direction indicates a position on the display image. Also, in A of FIG. 13 and B of FIG. 13, the dotted line indicates the pixel value of each pixel in a display image before filtering, and the solid line indicates the pixel value of each pixel in a display image obtained by applying filtering.

In A of FIG. 13, in the central region in the drawing on the display image before filtering is applied, the pixel values of pixels within that region are significantly larger than in the surrounding pixels, and the dotted line indicating the pixel values of pixels at individual positions projects at the central portion in the drawing. However, when filtering is applied, the pixel values of the pixels within the central region on the display image in the drawing become significantly smaller, and the solid line indicating the pixel values of pixels at individual positions becomes a substantially flat curve. That is, if the area of a white object on a display image is small, the pixel values of pixels of the object become smaller due to filtering using a low-pass filter, and become substantially the same values as the pixel values of the surrounding pixels.

In contrast, in B of FIG. 13, the pixel values of pixels within a region excluding the ends in the drawing on the display image before filtering is applied are significantly larger than in the surrounding pixels, and the dotted line indicating the pixel values of pixels at individual positions projects so as to be broad at the central portion. In B of FIG. 13, the region of large pixel values, that is, the region of a white object is larger than in A of FIG. 13.

Then, when filtering is applied to the display image, in the central region on the display image in the drawing, the pixel values of pixels within that region hardly change, and the solid line indicating the pixel values of pixels at individual positions become substantially the same curve as the dotted line. That is, if the area of a white object on a display image is large, the pixel values of pixels of that object hardly change even when filtering with a low-pass filter is applied.

Accordingly, on the basis of an image signal supplied from the filtering section 231, the changing section 232 changes the held cyclic coefficient in accordance with the number of pixels among pixels on the display image which have pixel values (luminances) equal to or above a previously determined threshold. For example, the larger the number of pixels having pixel values equal to or above a previously determined threshold, the larger the area of a white region on the display image, so the changing section 232 changes the cyclic coefficient so that the cyclic coefficient becomes smaller as the number of pixels becomes larger.

When the cyclic coefficient is changed by the changing section 232, and the cyclic coefficient is supplied to the multiplication section 143 of the cyclic processing section 122, thereafter, a process in step S94 to a process in step S102 are performed. Since these processes are the same as the process in step S12 to the process in step S20 in FIG. 7, description thereof is omitted.

In this way, the display apparatus 61 dynamically changes the cyclic coefficient in accordance with the size of the area of a white region on a display image.

By changing the cyclic coefficient in accordance with the size of the area of a white region on a display image in this way, it is possible to suppress an unwanted abrupt change in backlight luminance, thereby suppressing deterioration in the image quality of the display image. That is, the cyclic coefficient is changed such that the cyclic coefficient becomes smaller as a white region on the display image becomes larger. Thus, the cyclic coefficient is changed such that the backlight luminance changes relatively gently when a white region on the display image is small, and that the backlight luminance changes relatively greatly when a white region is large, thereby suppressing deterioration in the image quality of the display image. Also, since the cyclic coefficient is changed in accordance with the area of a white region, a situation does not arise in which variations in backlight luminance are suppressed so much that the backlight luminance becomes insufficient.

Further, in the case of displaying a display image on the liquid crystal panel 85 by using a plurality of the backlights 83, it is desired that the backlight luminance be always higher than the luminance of the display image to be displayed on the liquid crystal panel 85. From that point of view, it is desired that when the entire display image changes from a dark state to a bright state, the display image becomes bright as fast as possible, and when the entire display image changes from a bright state to a dark state, the display image becomes darker gradually.

Figure 14:
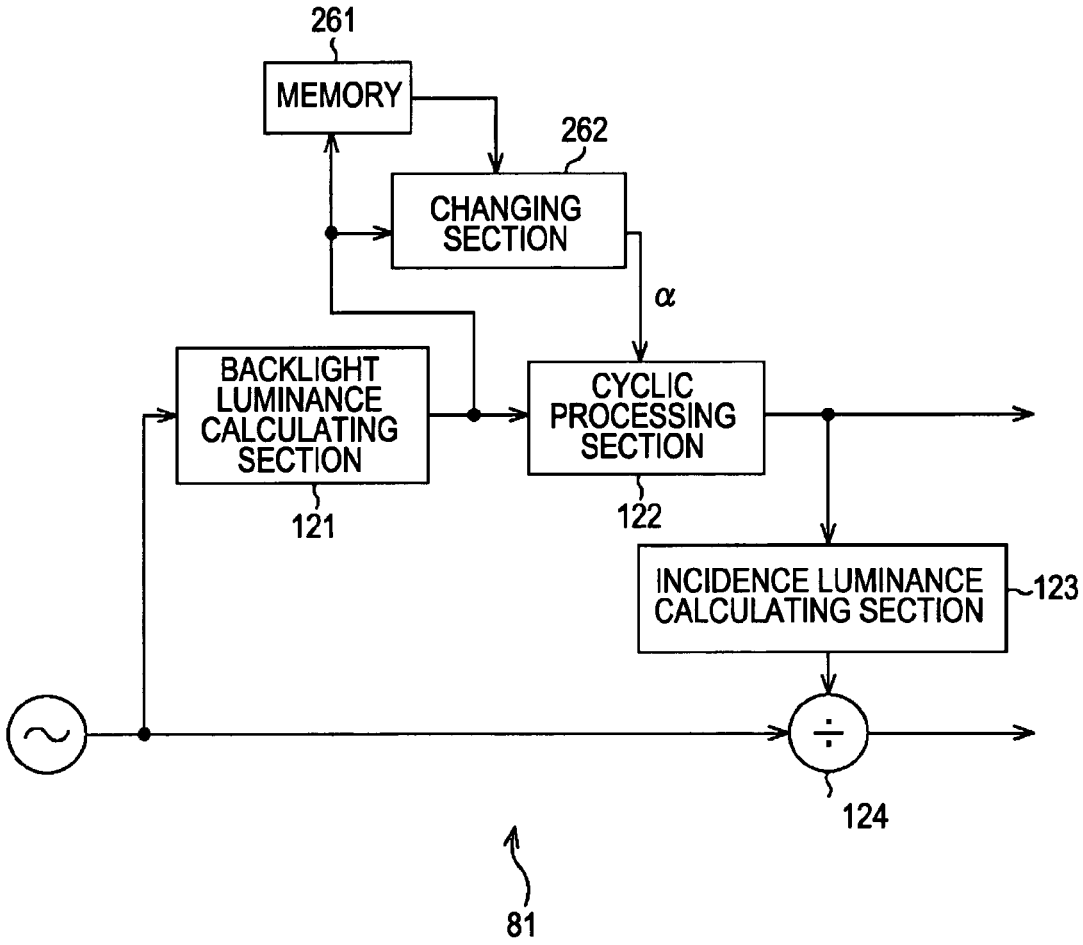
FIG. 14 is a diagram showing another configuration example of a display control section.

Accordingly, the cyclic coefficient may be changed in accordance with not the state of the display image but the variation in the backlight luminance itself. In such a case, the display control section 81 is configured as shown in FIG. 14, for example. It should be noted that in FIG. 14, portions corresponding to those in the case in FIG. 6 are denoted by the same reference numerals, and description thereof is omitted.

In the display control section 81 in FIG. 14, the display control section 81 in FIG. 6 is further provided with a memory 261 and a changing section 262. Also, the backlight luminance calculated by the backlight luminance calculating section 121 is supplied to the cyclic processing section 122, the memory 261, and the changing section 262.

The memory 261 holds a backlight luminance supplied from the backlight luminance calculating section 121 for a period of time equivalent to one frame, and supplies the held backlight luminance to the changing section 262. The changing section 262, which holds a cyclic coefficient, finds the difference between the backlight luminance supplied from the backlight luminance calculating section 121, and the backlight luminance held in the memory 261, and changes the held cyclic coefficient in accordance with the found difference. The changing section 262 supplies the changed cyclic coefficient to the cyclic processing section 122.

Figure 15:
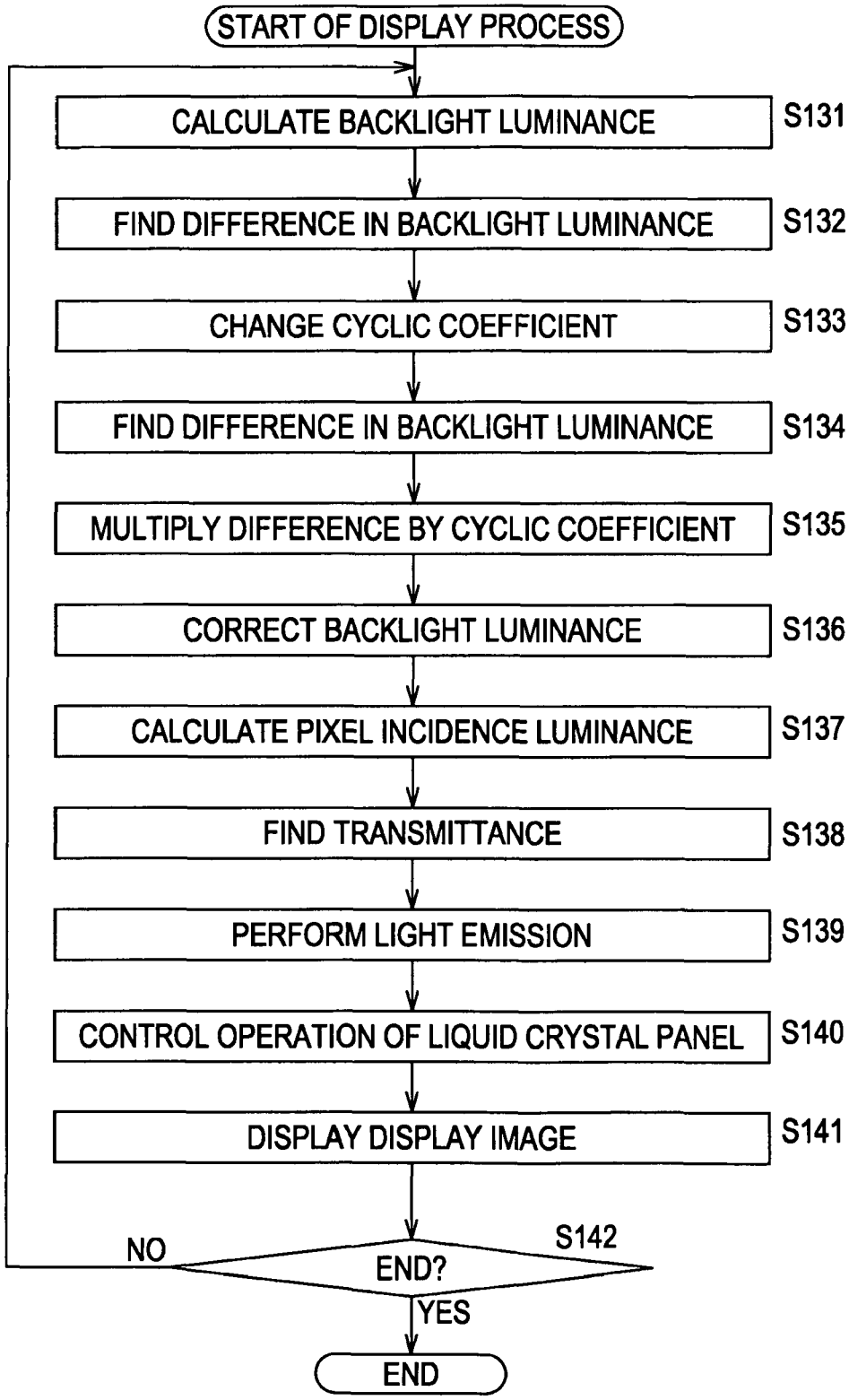
FIG. 15 is a flowchart explaining a display process.

Next, referring to the flowchart in FIG. 15, a description will be given of a display process in the case where the display control section 81 is configured as in FIG. 14.

In step S131, the backlight luminance calculating section 121 calculates a backlight luminance on the basis of a supplied image signal, and supplies the calculated backlight luminance to the addition section 141, the subtraction section 142, the memory 261, and the changing section 262. The memory 261 holds the backlight luminance supplied from the backlight luminance calculating section 121.

In step S132, the changing section 262 subtracts, from the backlight luminance of a predetermined frame to be displayed from now on which is supplied from the backlight luminance calculating section 121, the backlight luminance of a frame immediately preceding the predetermined frame temporally, which is supplied from the memory 261, thereby finding a difference in backlight luminance.

In step S133, the changing section 262 changes the cyclic coefficient on the basis of the found difference. For example, the changing section 262 changes the cyclic coefficient by subtracting a value that is determined in accordance with the found difference, from the held cyclic group. Here, the value that is determined in accordance with the difference is, for example, a value that becomes larger as the value of the difference becomes larger, such as a value obtained by dividing the difference by the larger in absolute value of the backlight luminances of the predetermined frame and of the preceding frame. In this case, the cyclic coefficient is changed in accordance with the sign and absolute value of the difference in backlight luminance.

By changing the cyclic coefficient in this way so that the cyclic coefficient becomes smaller as the difference in backlight luminance becomes larger, when the entire display image changes from a dark state to a bright state, the cyclic coefficient becomes smaller, and the display image changes to a bright state relatively fast. Also, when the entire display image changes from a bright state to a dark state, the cyclic coefficient becomes larger, and the display image becomes gradually darker. Therefore, an abrupt variation in backlight luminance is suppressed, thereby making it possible to suppress deterioration in the image quality of the display image.

Upon changing the cyclic coefficient, the changing section 262 supplies the changed cyclic coefficient to the multiplication section 143 of the cyclic processing section 122. Thereafter, a process in step S134 to a process in step S142 are performed. Since these processes are the same as the process in step S12 to the process in step S20 in FIG. 7, description thereof is omitted.

In this way, the display apparatus 61 dynamically changes the cyclic coefficient in accordance with the difference in backlight luminance. By dynamically changing the cyclic coefficient on the basis of the difference in backlight luminance in this way, the cyclic coefficient can be changed appropriately with respect to a change in the state of the display image. As a result, an abrupt variation in backlight luminance is suppressed, thereby making it possible to suppress deterioration in the image quality of the display image. Also, a situation does not arise in which variations in backlight luminance are suppressed so much that the backlight luminance becomes insufficient.

The series of processes described above can be either executed by hardware or executed by software. If the series of processes is to be executed by software, a program constituting the software is installed into a computer embedded in dedicated hardware, or into, for example, a general purpose computer that can execute various functions when installed with various programs, from a program-recording medium.

Figure 16:
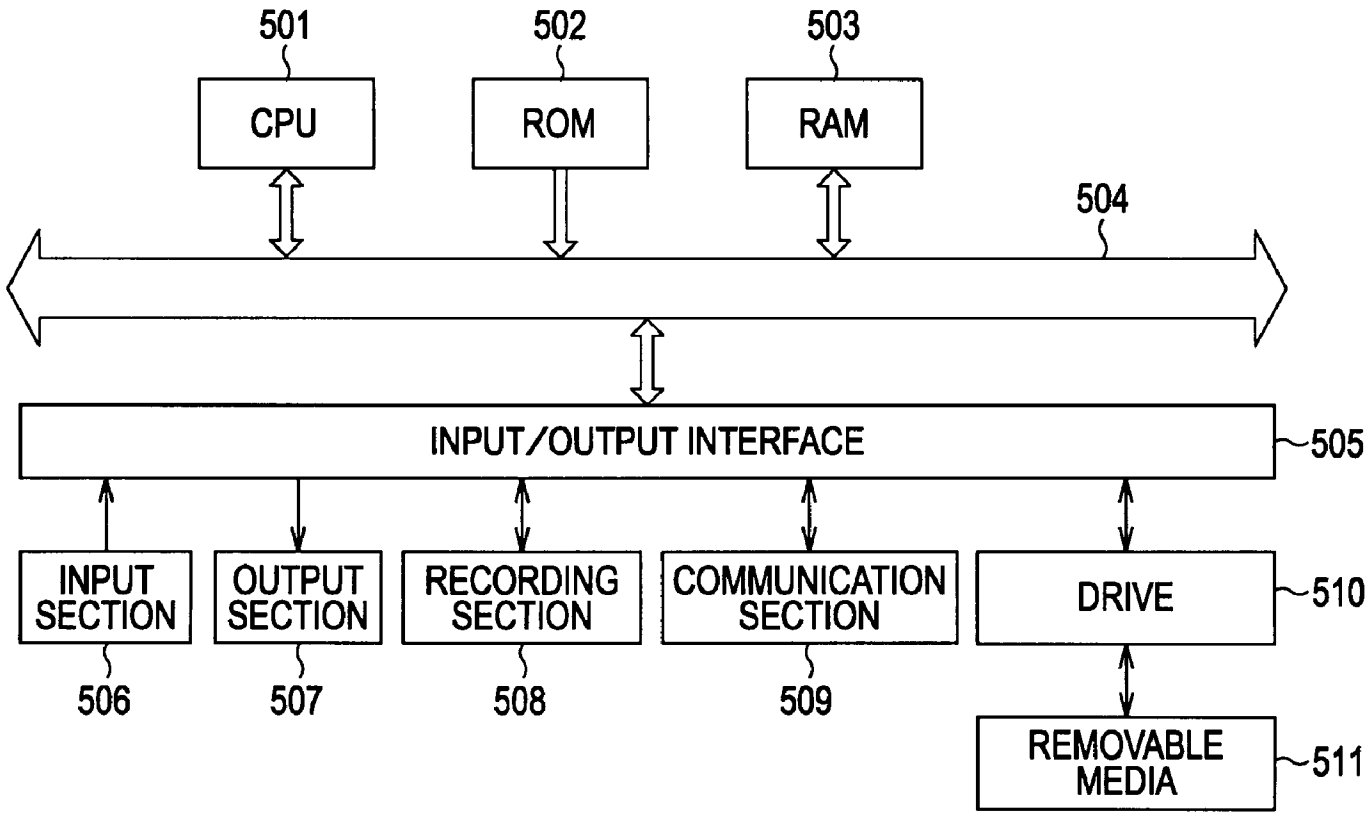
FIG. 16 is a diagram showing a configuration example of a computer.

FIG. 16 is a block diagram showing a hardware configuration example of a computer that executes the above-described series of processes by a program.

In the computer, a CPU (Central Processing Unit) 501, a ROM (Read Only Memory) 502, and a RAM (Random Access Memory) 503 are connected to each other by a bus 504.

The bus 504 is further connected with an input/output interface 505. The input/output interface 505 is connected with an input section 506 made of a keyboard, a mouse, a microphone, or the like, an output section 507 made of a display, a speaker, or the like, a recording section 508 made of a hard disk, a non-volatile memory, or the like, a communication section 509 made of a network interface or the like, and a drive 510 that drives removal media 511 such as a magnetic disk, an optical disc, a magneto-optical disc, or a semiconductor memory.

In the computer configured as above, for example, the CPU 501 executes a program recorded in the recording section 508 by loading the program into the RAM 503 via the input/output interface 505 and the bus 504, thereby performing the above-described series of processes.

The program executed by the computer (CPU 501) is provided by, for example, being recorded on the removable media 511, which is packaged media made of a magnetic disk (including a flexible disk), an optical disc, a magneto-optical disc, a semiconductor memory, or the like, or via a wired or wireless transmission medium, such as a local area network, the Internet, or digital satellite broadcast.

Then, the program can be installed into the recording section 508 via the input/output interface 505, by mounting the removable media 511 in the drive 510. Also, the program can be received by the communication section 509 via a wired or wireless transmission medium, and installed into the recording medium 508. Alternatively, the program can be installed into the ROM 502 or the recording section 508 in advance.

The program executed by the computer may be a program in which processes are performed in time series in the order described in this specification, or may be a program in which processes are performed in parallel or at necessary timing, such as when invoked.

It should be noted that an embodiment of the present invention is not limited to the above-described embodiment, but various modifications are possible without departing from the scope of the present invention.

EXPLANATION OF REFERENCE NUMERALS

61 display apparatus, 81-1 to 81-4, 81 display control section, 82-1 to 82-4, 82 backlight control section, 83-1 to 83-4,

83 backlight, 84 liquid crystal panel control section, 85 liquid crystal panel, 121 backlight luminance calculating section, 122 cyclic processing section, 123 incidence luminance calculating section, 124 division section, 141 addition section, 142 subtraction section, 143 multiplication section, 171 cyclic coefficient calculating section, 201 mean luminance calculating section, 203 changing section, 231 filtering section, 232 changing section, 262 changing section

The invention claimed is:

1. A display control apparatus comprising:

a plurality of luminance calculating devices to calculate backlight luminances individually for a plurality of backlights, on the basis of an image signal of a display image, the backlight luminances indicating luminances of light which are made incident on a display panel that displays the display image by transmitting light, and which are radiated by the plurality of backlights;

a plurality of difference calculating devices to calculate differences between the plurality of backlight luminances of the display image of a predetermined frame to be displayed from now on, and the plurality of backlight luminances of the display image of a preceding frame temporally preceding the predetermined frame;

a plurality of correcting devices to correct the plurality of backlight luminances of the predetermined frame by using correction values, which are determined by a coefficient indicating a degree of contribution of the differences to correction of the plurality of backlight luminances and by the differences; and a plurality of transmittance calculating devices to calculate transmittances of light from the plurality of backlights in the display panel, on the basis of the corrected plurality of backlight luminances and the image signal;

wherein each of the plurality of transmittance calculating devices calculates each of the transmittances with respect to each of regions of the display panel corresponding to the plurality of backlights.

2. The display control apparatus according to claim 1, further comprising:

a coefficient changing device to change the coefficient on the basis of brightness of the display image.

3. The display control apparatus according to claim 1, further comprising:

a mean luminance calculating device to calculate a mean luminance of the display image on the basis of the image signal; and a coefficient changing device to change the coefficient on the basis of a difference between the mean luminance of the display image of the predetermined frame, and the mean luminance of the display image of the preceding frame.

4. The display control apparatus according to claim 1, further comprising:

a filtering device to apply filtering using a low-pass filter to the display image; and a coefficient changing device to change the coefficient, on the basis of the number of pixels with pixel values equal to or above a predetermined value in the display image of the predetermined frame to which the filtering has been applied.

5. The display control apparatus according to claim 1, further comprising:

a coefficient changing device to change the coefficient on the basis of differences between the plurality of backlight luminances of the predetermined frame, and the plurality of backlight luminances of the preceding frame.

6. A display control method for a display control apparatus including a plurality of luminance calculating devices to calculate backlight luminances individually for a plurality of backlights, on the basis of an image signal of a display image, the backlight luminances indicating luminances of light which are made incident on a display panel that displays the display image by transmitting light, and which are radiated by the plurality of backlights, a plurality of difference calculating devices to calculate differences between the plurality of backlight luminances of the display image of a predetermined frame to be displayed from now on, and the backlight luminances of the display image of a preceding frame temporally preceding the predetermined frame, a plurality of correcting devices to correct the plurality of backlight luminances of the predetermined frame by using correction values, which are determined by a coefficient indicating a degree of contribution of the differences to correction of the plurality of backlight luminances and by the differences, and a plurality of transmittance calculating devices to calculate transmittances of light from the plurality of backlights in the display panel, on the basis of the corrected plurality of backlight luminances and the image signal, the display control method comprising the steps of:

the plurality of luminance calculating devices calculating the backlight luminances individually for the plurality of backlights of the display image of the predetermined frame;

the plurality of difference calculating devices calculating the differences between the plurality of backlight luminances;

the plurality of correcting devices correcting the plurality of backlight luminances of the predetermined frame, by using the correction values that are determined by the coefficient and the differences; and the plurality of transmittance calculating devices each calculating each of the transmittances with respect to each of regions of the display panel corresponding to the plurality of backlights, on the basis of the plurality of backlight luminances and the image signal.

7. A non-transitory computer readable medium having stored thereon a program for causing a computer to execute processing including the steps of:

calculating backlight luminances individually for a plurality of backlights, on the basis of an image signal of a display image, the backlight luminances indicating luminances of light which are made incident on a display panel that displays the display image by transmitting light, and which are radiated by the plurality of backlights;

calculating differences between the plurality of backlight luminances of the display image of a predetermined frame to be displayed from now on, and the plurality of backlight luminances of the display image of a preceding frame temporally preceding the predetermined frame; and correcting the plurality of backlight luminances of the predetermined frame by using correction values, which are determined by a coefficient indicating a degree of contribution of the differences to correction of the plurality of backlight luminances and by the differences, and calculating each of transmittances of light from the plurality of backlights in the display panel with respect to each of regions of the display panel corresponding to the plurality of backlights, on the basis of the corrected plurality of backlight luminances and the image signal.

* * * * *